US010253980B2

(12) United States Patent
Bowser, Jr.

(10) Patent No.: US 10,253,980 B2
(45) Date of Patent: Apr. 9, 2019

(54) COKE OVEN CORBEL STRUCTURES

(71) Applicant: FOSBEL, INC., Brook Park, OH (US)

(72) Inventor: Alan E. Bowser, Jr., Brook Park, OH (US)

(73) Assignee: FOSBEL, INC., Brook Park, OH (US)

( * ) Notice: Subject to any disclaimer, the term of this patent is extended or adjusted under 35 U.S.C. 154(b) by 490 days.

(21) Appl. No.: 15/067,296

(22) Filed: Mar. 11, 2016

(65) Prior Publication Data

US 2016/0281983 A1 Sep. 29, 2016

Related U.S. Application Data

(60) Provisional application No. 62/138,615, filed on Mar. 26, 2015.

(51) Int. Cl.

| | |
|---|---|
| ***C10B 29/02*** | (2006.01) |
| ***C10B 5/02*** | (2006.01) |
| ***F23M 5/02*** | (2006.01) |
| ***F27D 1/04*** | (2006.01) |

(52) U.S. Cl.

CPC ..... *F23M 5/02* (2013.01); *C10B 29/02* (2013.01); *F27D 1/04* (2013.01); *C10B 5/02* (2013.01)

(58) Field of Classification Search

CPC .... C10B 3/00; C10B 3/02; C10B 5/00; C10B 5/02; C10B 5/04; C10B 5/06; C10B 5/08; C10B 5/10; C10B 5/12; C10B 5/14; C10B 5/16; C10B 5/18; C10B 5/20; C10B 15/00; C10B 15/02; C10B 29/02; F27D 1/04;

(Continued)

(56) References Cited

U.S. PATENT DOCUMENTS 1,312,372 A * 8/1919 Van Ackeren ..... C10B 5/02 202/142
1,410,784 A * 3/1922 Van Ackeren ..... C10B 5/02 202/144

(Continued)

OTHER PUBLICATIONS

Shuguang Ouyang et al; *Application of SketchUp in Coke Oven Three-Dimensional Digital Modeling*, International Journal of Computer Science Issues, vol. 10, Issue 1, No. 2, Jan. 2013.

(Continued)

*Primary Examiner* — Jonathan Miller
*Assistant Examiner* — Jonathan Luke Pilcher
(74) *Attorney, Agent, or Firm* — Nixon & Vanderhye P.C.

(57) ABSTRACT

Coke oven corbel structures include an assembly of multiple stacked tiers of refractory blocks defining a plurality of substantially vertically oriented central flues and a plurality of diagonally oriented lateral flues. At least one tier of refractory blocks in the assembly includes by an alternating plurality of saddle blocks and central diagonal flue blocks. The saddle blocks may include a laterally opposed pair of upright columns which define therebetween a rectangular channel, and a substantially vertically oriented cylindrical flue extending from a bottom surface of the saddle blocks to the rectangular channel thereof. The central diagonal flue blocks may include an arcuately concave flue channel defined between top and bottom surfaces thereof so that an upper opening to the flue channel at the top surface is inwardly offset relative to a lower opening thereof at the bottom surface.

16 Claims, 45 Drawing Sheets

(58) Field of Classification Search
CPC . F27D 1/042; F27D 1/06; F27D 1/063; F27D 1/066
USPC ..... 202/222, 223
See application file for complete search history.

(56) References Cited

U.S. PATENT DOCUMENTS 1,411,224 A * 3/1922 Roberts ..... C10B 5/00 202/143
1,416,322 A * 5/1922 Becker ..... C10B 5/02 202/142
1,469,491 A * 10/1923 Van Ackeren ..... C10B 5/02 202/143
1,516,082 A * 11/1924 Cravau ..... C10B 5/02 202/142
1,603,992 A * 10/1926 Sommer ..... C10B 5/02 202/141
1,754,131 A * 4/1930 Van Ackeren ..... C10B 5/02 202/143
1,799,670 A * 4/1931 Becker ..... C10B 3/00 202/134
1,832,613 A * 11/1931 Becker ..... C10B 5/02 202/142
2,077,842 A * 4/1937 Kuhl ..... C10B 29/02 202/223
2,088,532 A * 7/1937 Pavitt ..... C10B 29/02 202/267.1
2,098,013 A * 11/1937 Pavitt ..... C10B 5/10 202/142
2,273,886 A * 2/1942 Otto ..... C10B 5/10 202/141
2,376,718 A * 5/1945 Otto ..... C10B 29/02 202/133
2,851,760 A * 9/1958 Taylor ..... C10B 29/06 138/98
3,190,815 A * 6/1965 Wethly ..... C10B 5/16 202/144
3,211,632 A * 10/1965 Otto ..... C10B 5/02 202/135
5,137,603 A * 8/1992 Arthur, Jr. ..... C10B 29/02 202/139
6,066,236 A 5/2000 Gilroy
8,266,853 B2 9/2012 Bloom et al.
8,640,635 B2 2/2014 Bloom et al.
2010/0287871 A1* 11/2010 Bloom ..... C10B 5/12 52/505
2013/0015050 A1* 1/2013 Bloom ..... C10B 5/12 202/99
2016/0145494 A1* 5/2016 Bowser, Jr. ..... C10B 29/02 202/267.1
2016/0264870 A1* 9/2016 Bowser, Jr. ..... C10B 29/02

OTHER PUBLICATIONS

International Search Report and Written Opinion, PCT/US2016/021916, dated Jun. 2, 2016.

* cited by examiner

COKE OVEN CORBEL STRUCTURES

CROSS-REFERENCE TO RELATED APPLICATION

This application is based on and claims domestic priority benefits under 35 USC § 119(e) from U.S. Provisional Patent Application Ser. No. 62/138,615 filed on Mar. 26, 2015, and may be deemed to be related to commonly owned copending U.S. patent application Ser. No. 14/947,320 filed on Nov. 20, 2015 and Ser. No. 15/067,340 filed on Mar. 11, 2016 (now abandoned), the entire content of each prior filed application being expressly incorporated hereinto by reference.

FIELD

The embodiments disclosed herein relate generally to coke ovens, especially corbel structures associated with coke ovens. In preferred embodiments, the corbel structures disclosed herein are formed of an assembly of monolithic refractory blocks.

BACKGROUND

Coke ovens traditionally comprise massive refractory brick structures in which there are batteries of adjacent parallel walls constructed from a large variety of differently shaped refractory bricks. The bricks must be able to withstand high temperatures and strong mechanical loading. At the same time, the interior of the walls contains flue ducts, burners, flue gas control passages and the like. The detailed design of the oven is usually quite complicated in order to obtain the necessary heat distribution within the oven and gas flows through the walls.

It follows from the above that coke ovens are relatively costly structures and any downtime for servicing and repairs can represent a significant economic loss for an operator.

Further, the production of ceramic bricks from which the walls are made is relatively costly and there is accordingly a need to generally reduce the number of different types of bricks which are used in a wall. It is undesirable, however, to have a design concept which utilizes relatively large ceramic bricks in the construction. Excessively large bricks cannot be handled without the use of specialized mechanical lifting devices. Additionally, bricks having a dimension greater than 650 mm machine pressed to form a fused silica product are generally unavailable. Bricks greater than this size can be hand cast but these are much more expensive. Large bricks can be machine pressed from conventional silica, but conventional silica bricks would have a very serious disadvantage in that a wall made therefrom would need a heat-up time which is many times greater than that for fused silica bricks.

U.S. Pat. Nos. 6,066,236, 8,266,853 and 8,640,635 (the entire content of each such patent being expressly incorporated hereinto be reference) have proposed that relatively large-sized monolithic refractory blocks may be assembled to form the corbel structures of coke ovens. In general, the assembly of such large-sized monolithic refractory blocks enables the coke ovens to be constructed and/or repaired with much less production down time.

While such prior proposals for coke oven corbel structures are satisfactory for their intended purpose, continual improvements are sought. It is towards providing such improvements that the embodiments disclosed herein are directed.

SUMMARY

The coke oven corbel structures of the embodiments disclosed herein include an assembly of multiple stacked tiers of refractory blocks defining a plurality of substantially vertically oriented central flues and a plurality of diagonally oriented lateral flues. At least one tier of refractory blocks in the assembly includes an assembly of multiple stacked tiers of refractory blocks defining a plurality of substantially vertically oriented central flues and a plurality of generally diagonally oriented lateral flues provided by an alternating plurality of saddle blocks and central diagonal flue blocks. The saddle blocks comprise a laterally opposed pair of upright columns which define therebetween a rectangular channel, and a substantially vertically oriented cylindrical flue extending from a bottom surface of the saddle blocks to the rectangular channel thereof. The central diagonal flue blocks comprise an arcuately concave flue channel defined between top and bottom surfaces thereof so that an upper opening to the flue channel at the top surface is inwardly offset relative to a lower opening thereof at the bottom surface.

According to some embodiments, the saddle blocks and the central diagonal flue blocks are generally trapezoidal having step surfaces on opposed lateral edges thereof. The saddle blocks may alternatively or additionally comprise a cylindrical boss which is received within a correspondingly configured cylindrical recess of another block in subjacent tier of the corbel structure. The central diagonal flue blocks may be alternately oppositely oriented in the at least one tier of refractory blocks so that the lower openings thereof are positioned on alternately opposite laterals sides of the corbel structure.

The at least one tier of refractory blocks may also comprise a series of substantially Z-shaped blocks having a central post section and oppositely oriented ledge sections at each end of the central post section. One of the ledge sections of the Z-shaped blocks may thus be received and supported by a respective one of the step surfaces of the saddle blocks and the central diagonal flue blocks.

At least one tier of refractory blocks may also comprise a series of substantially T-shaped blocks laterally adjacent to the series of Z-shaped blocks. If present, the T-shaped blocks include a central column and opposed outwardly projecting ledge sections at an upper end of the central column, wherein one of the outwardly projecting ledge sections of the T-shaped blocks is received and supported by a respective oppositely oriented ledge section of the Z-shaped blocks.

Certain embodiments will include at least one generally trapezoidal spacer block positioned adjacent one of the saddle blocks and central diagonal flue blocks in the at least one tier of blocks.

At least one of the saddle blocks in the tier of blocks may further comprise a pair of oppositely oriented arcuate lateral flues on respective lateral sides of the substantially vertically oriented cylindrical flue.

The rectangular channel defined by the saddle blocks may comprise a cylindrical recess at an upper end of the substantially oriented vertical flue. Alternatively or additionally, the bottom surface of the saddle blocks may include a cylindrical boss at a lower end of the substantially vertical cylindrical flue. The at least one tier of refractory blocks may also be provided with substantially rectangular flue blocks received within a respective one of the rectangular channels of the saddle blocks.

The assembly of multiple stacked tiers of refractory blocks according to some embodiments of the corbel structure may further comprise a second tier of refractory blocks subjacent to the at least one tier of refractory blocks which includes an alternating series of central flue blocks and diagonal flue blocks. The central flue blocks may thus define a substantially vertical flue section in fluid communication with the substantially vertically oriented cylindrical flue of the saddle blocks. The diagonal flue blocks may define a downwardly and outwardly inclined surface at one end thereof in fluid communication with the lower opening of the arcuately concave flue channel defined by a respective one of the central diagonal flue blocks in the at least one tier of refractory blocks.

The central diagonal flue blocks of the at least one tier of refractory blocks may be alternately oppositely oriented so that the lower openings of the arcuately concave flues are positioned on alternately opposite laterals sides of the corbel structure. In such embodiments, the diagonal flue blocks of the second tier of refractory blocks may be alternately oppositely oriented so that the inclined surface at one end thereof is in fluid communication with a respective one of the arcuately concave flue channels of the central diagonal flue blocks of the at least one tier of refractory blocks.

Certain embodiments herein will include at least one additional tier comprised of a plurality of tongue-and-groove interconnected refractory blocks. The plurality of interconnected refractory blocks of the at least one tier may comprise mutually substantially orthogonal faces defining an edge and respectively including an elongate tongue protruding outwardly therefrom and an elongate groove recessed therein. The elongate tongue and groove include respective adjacent ends which co-terminate with one another at the edge defined by the mutually orthogonal faces of the refractory blocks.

The multiple stacked tiers of refractory blocks may optionally include a respective end block having a front face, wherein the front face includes a substantially vertically oriented tongue and a substantially vertically oriented groove parallel with the tongue, the tongue and groove of the front face being interconnected with a groove and tongue, respectively, of a substantially vertical face of an adjacent block in the tier.

These and other aspects and advantages of the present invention will become more clear after careful consideration is given to the following detailed description of the preferred exemplary embodiments thereof.

BRIEF DESCRIPTION OF ACCOMPANYING DRAWINGS

The disclosed embodiments of the present invention will be better and more completely understood by referring to the following detailed description of exemplary non-limiting illustrative embodiments in conjunction with the drawings of which:

FIGS. 4A through 4C show an end block associated with the first tier of blocks forming the corbel structure, wherein FIG. 4A is a perspective view thereof, FIG. 4B is a top plan view thereof and FIG. 4C is a front elevational view thereof;

FIGS. 4D through 4F show a first channel block associated with the first tier of blocks forming the corbel structure, wherein FIG. 4D is a perspective view thereof, FIG. 4E is a top plan view thereof and FIG. 4F is an end elevational view thereof;

FIGS. 4G through 4I show a second channel block associated with the first tier of blocks forming the corbel structure, wherein FIG. 4G is a perspective view thereof, FIG. 4H is a top plan view thereof and FIG. 4I is an end elevational view thereof;

FIGS. 6A through 6E show a central end block associated with the second tier of blocks forming the corbel structure, wherein FIG. 6A is a perspective view thereof, FIG. 6B is a bottom plan view thereof, FIG. 6C is a side elevational view thereof, FIG. 6D is a rear end elevational view thereof, and FIG. 6E is a cross-sectional elevational view thereof as taken along line 6D-6D in FIG. 6A;

FIGS. 7A through 7D show a first lateral end block associated with the second tier of blocks forming the corbel structure, wherein FIG. 7A is a perspective view thereof, FIG. 7B is a top plan view thereof, FIG. 7C is a front elevational view thereof, and FIG. 7D is an end elevational view thereof;

FIGS. 8A through 8D show a second lateral end block associated with the second tier of blocks forming the corbel structure, wherein FIG. 8A is a perspective view thereof, FIG. 8B is a top plan view thereof, FIG. 8C is a front elevational view thereof, and FIG. 8D is an end elevational view thereof;

FIGS. 9A through 9D show a central flue block associated with the second tier of blocks forming the corbel structure, wherein FIG. 9A is a perspective view thereof, FIG. 9B is a top plan view thereof, FIG. 9C is a bottom plan view thereof, and FIG. 9D is an end elevational view thereof;

FIGS. 10A through 10D show a central spacer block associated with the second tier of blocks forming the corbel structure, wherein FIG. 10A is a perspective view thereof, FIG. 10B is a top plan view thereof, and FIG. 10C is a bottom plan view thereof, and FIG. 10D is an end elevational view thereof;

FIGS. 11A through 11D show a first type of elongate key block associated with the second tier of blocks forming the corbel structure, wherein FIG. 11A is a perspective view thereof, FIG. 11B is a top plan view thereof, FIG. 11C is a side elevational view thereof, and FIG. 11D is a front elevational view thereof;

FIGS. 12A through 12D show a second type of elongate key block associated with the second tier of blocks forming the corbel structure, wherein FIG. 12A is a perspective view thereof, FIG. 12B is a top plan view thereof, FIG. 12C is a rear end elevational view thereof, and FIG. 12D is a front end elevational view thereof;

FIGS. 14A through 14E show a central end block associated with the third tier of blocks forming the corbel structure, wherein FIG. 14A is a perspective view thereof, FIG. 14B is a top plan view thereof, FIG. 14C is a bottom plan view thereof, FIG. 14D is a front elevational view thereof, and FIG. 14E is a side elevational view thereof;

FIGS. 15A through 15E show a lateral end block associated with the third tier of blocks forming the corbel structure, wherein FIG. 15A is a perspective view thereof, FIG. 15B is a top plan view thereof, FIG. 15C is a bottom plan view thereof, FIG. 15D is a side elevational view thereof and FIG. 15E is an end elevational view thereof;

Figure 16A:
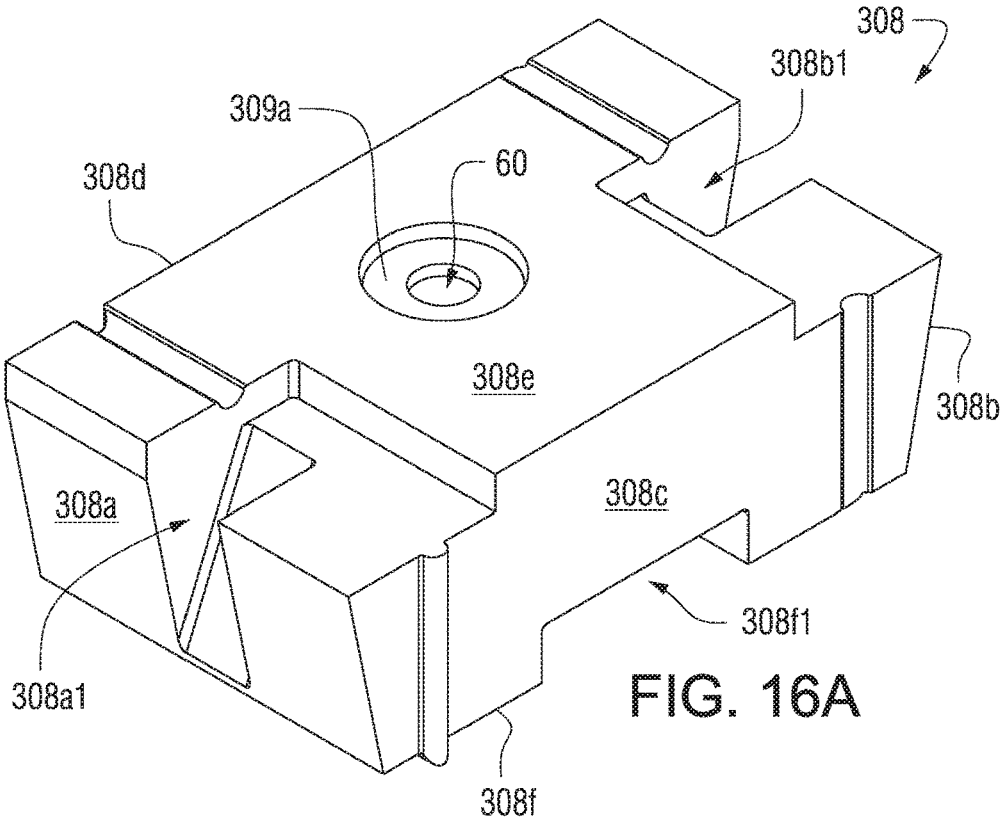
Figure 16B:
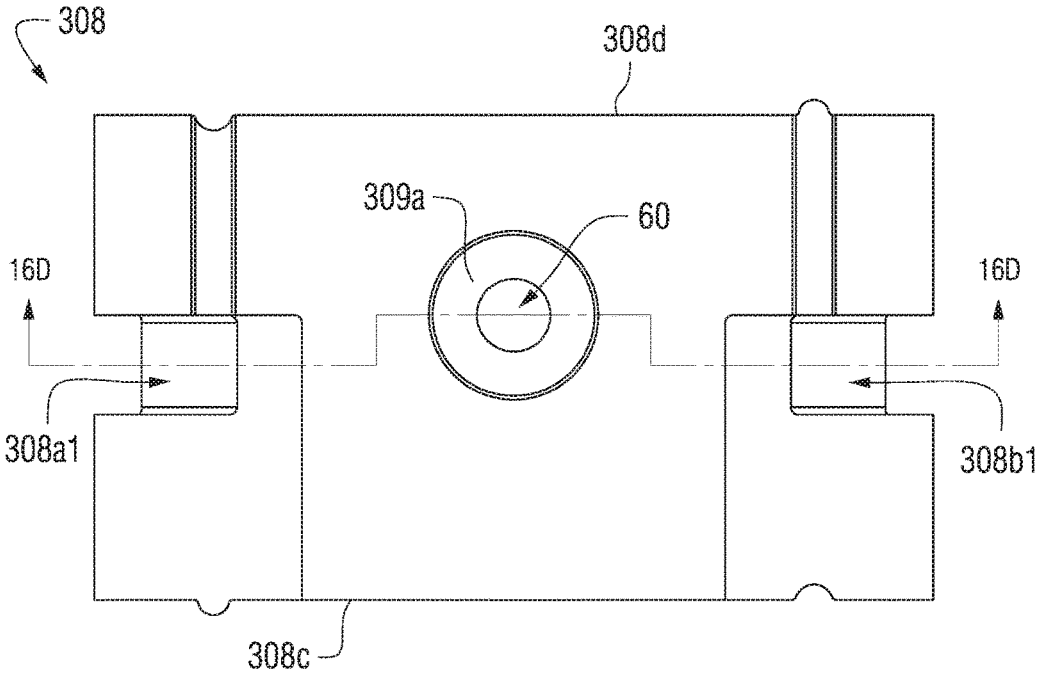
Figure 16C:
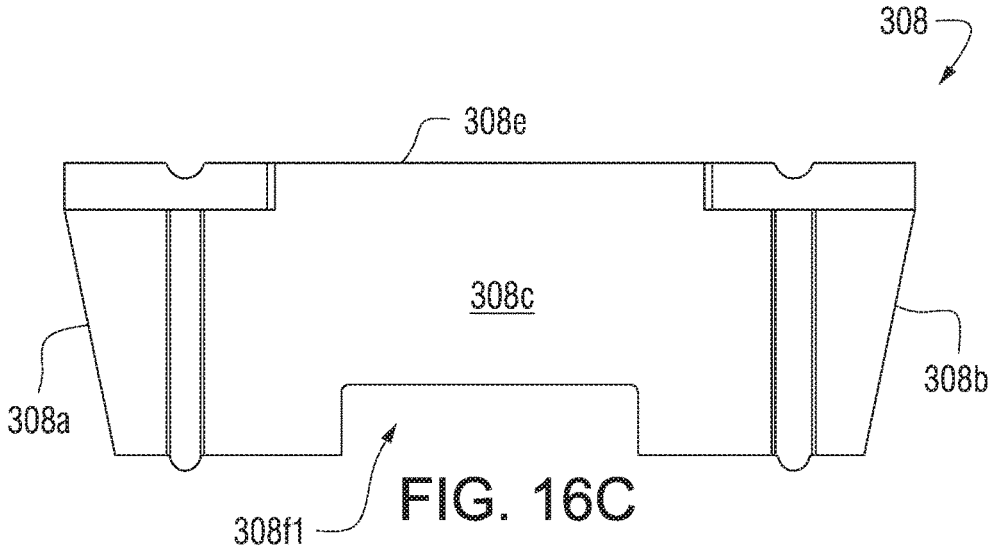
Figure 16D:
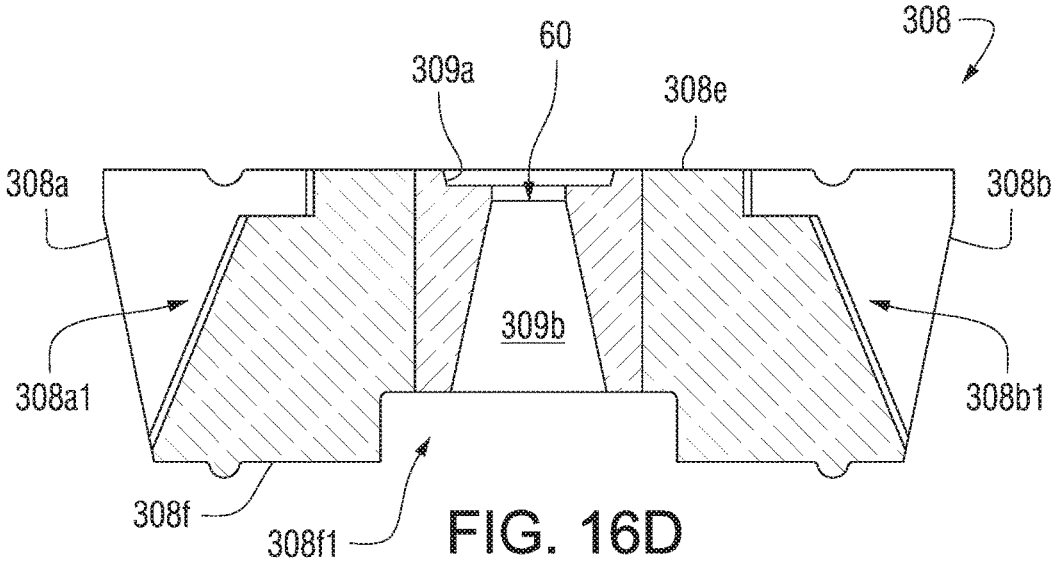
Figure 17A:
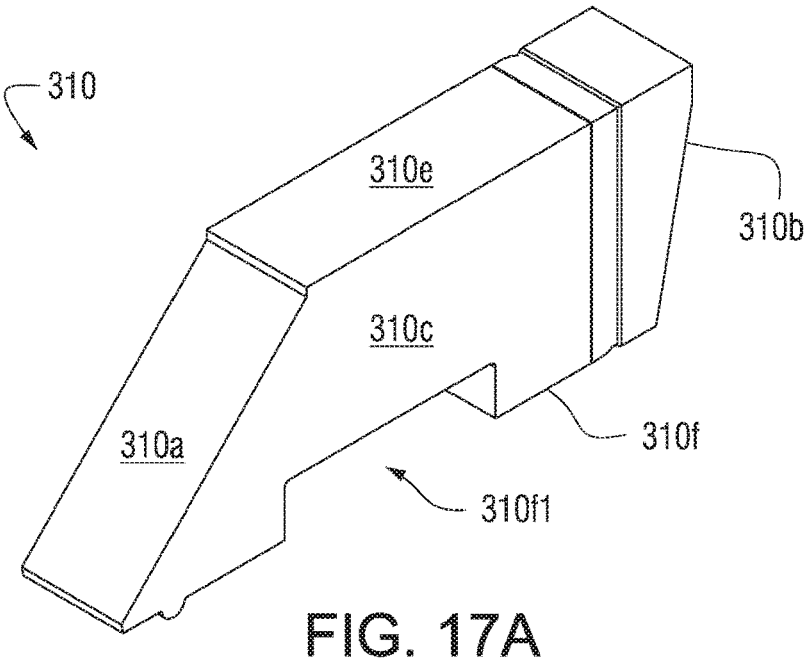
Figure 17B:
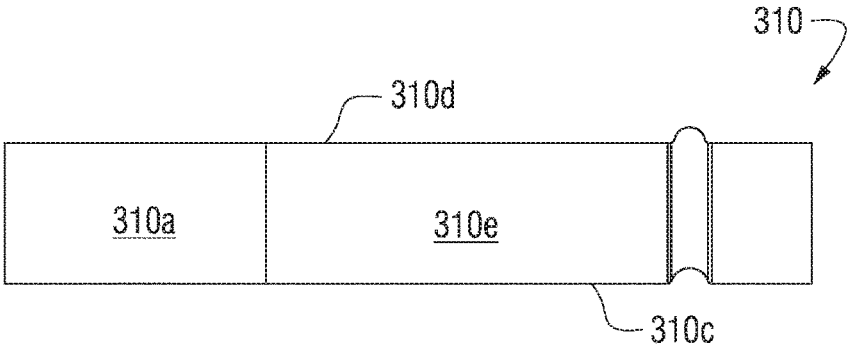
Figure 17C:
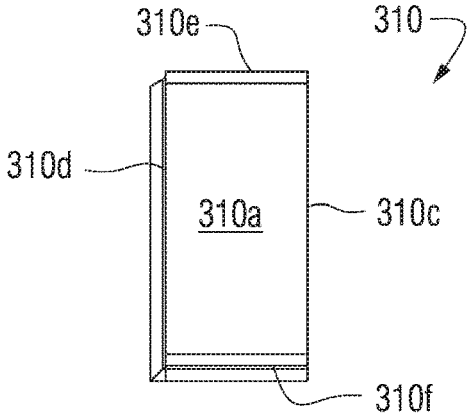
Figure 18A:
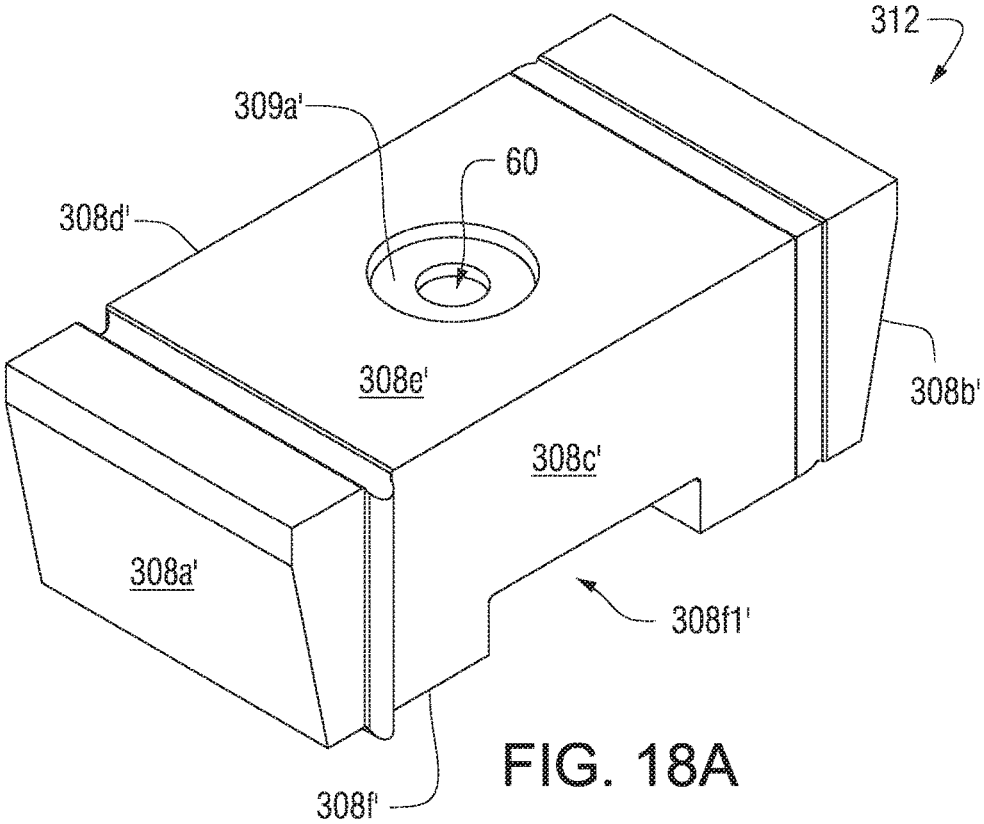
Figure 18B:
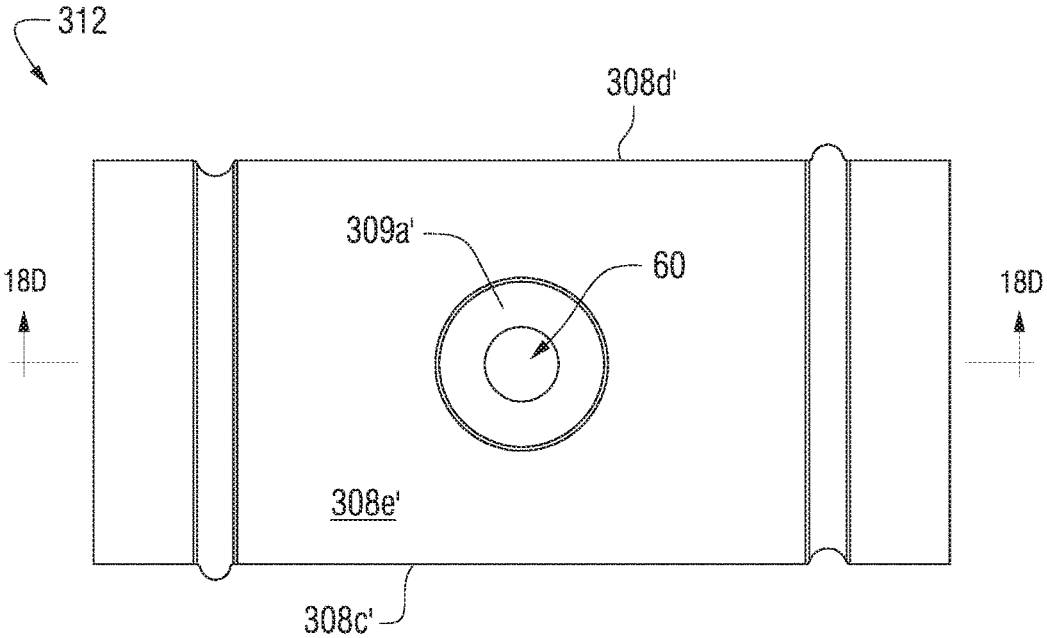
Figure 18C:
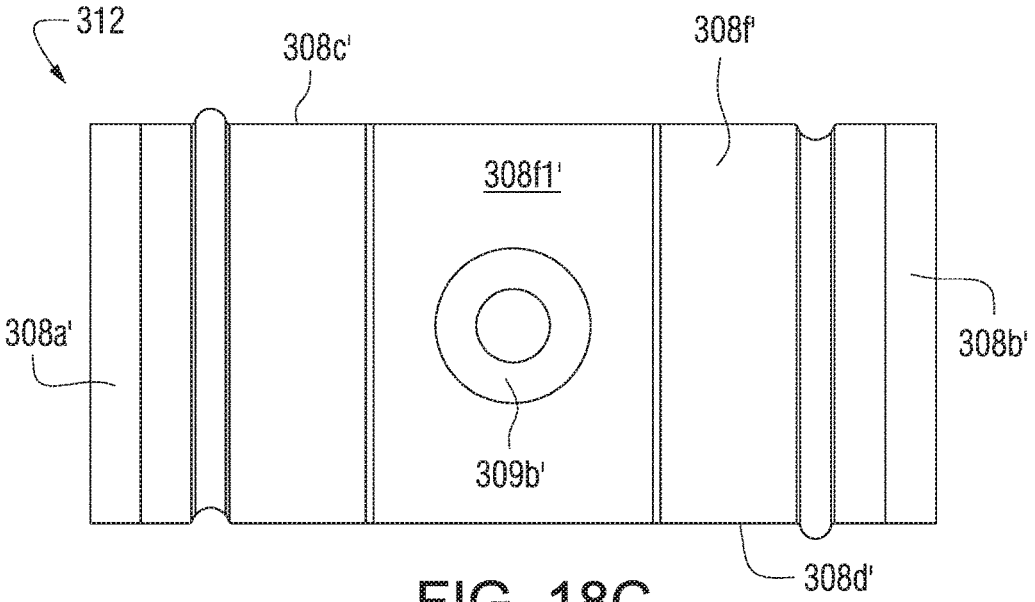
Figure 18D:
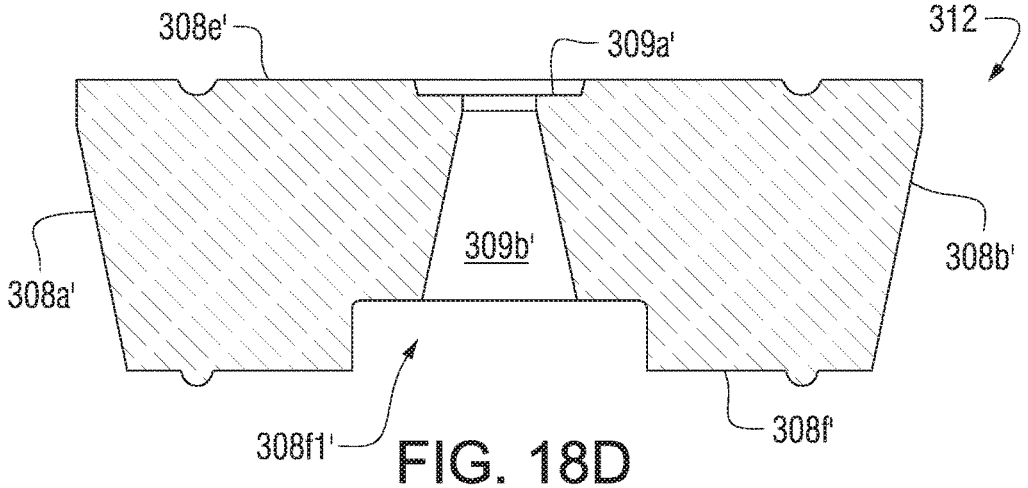
Figure 18E:
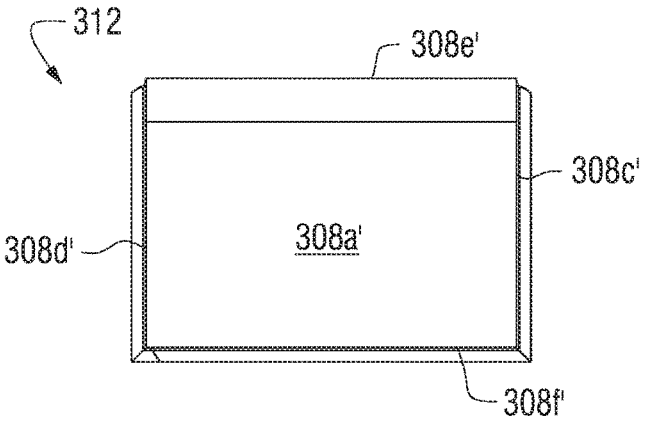
Figure 19A:
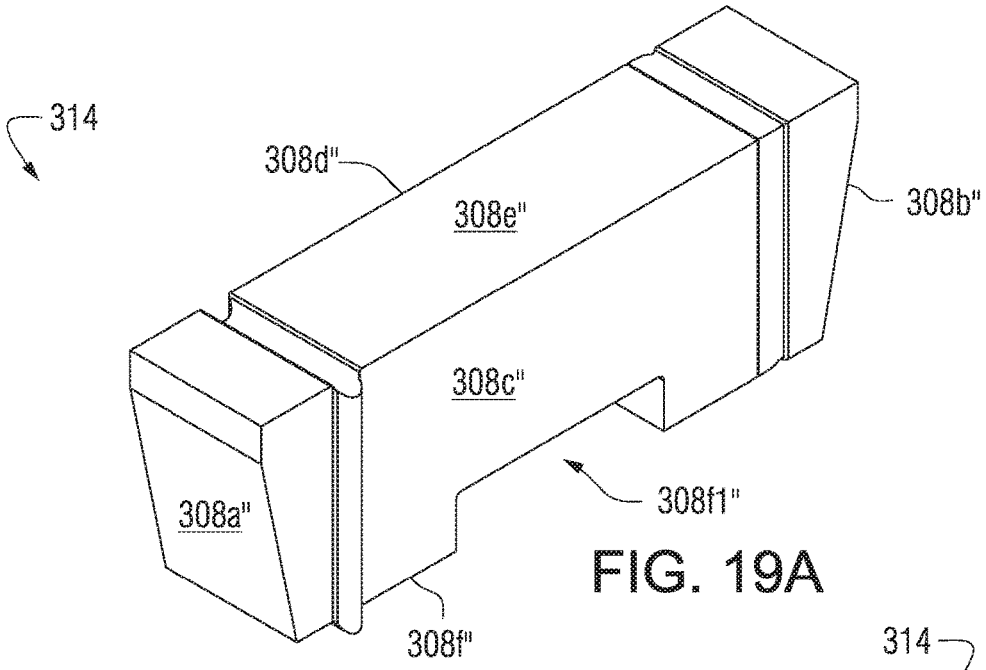
Figure 19B:
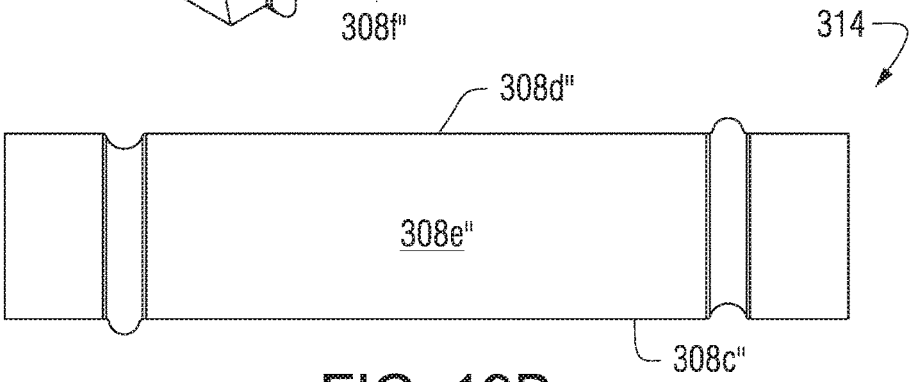
Figure 19C:
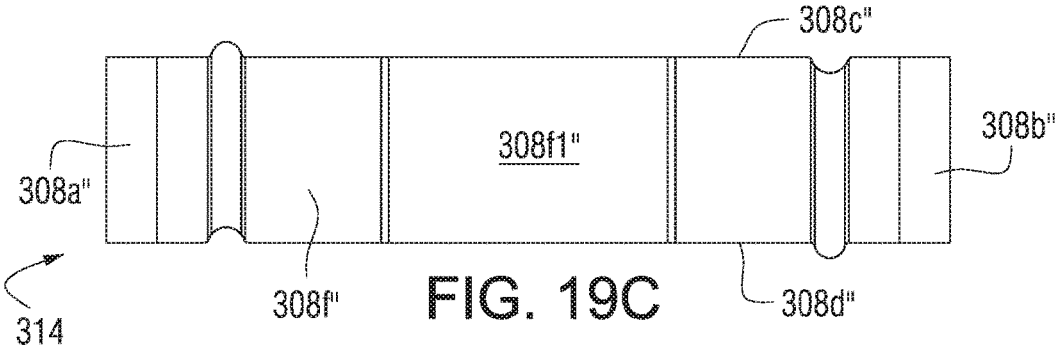
Figure 20:
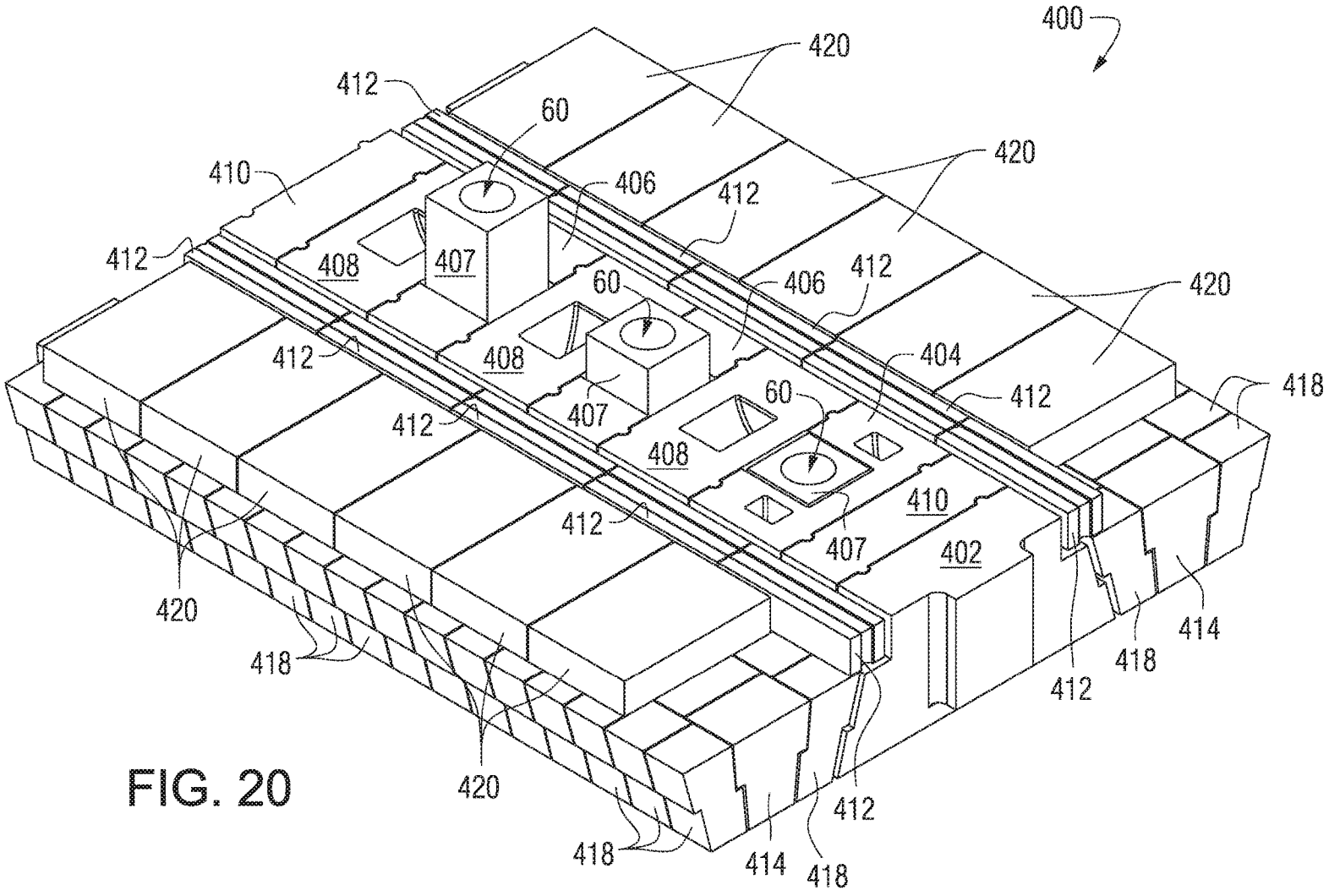
Figure 21A:
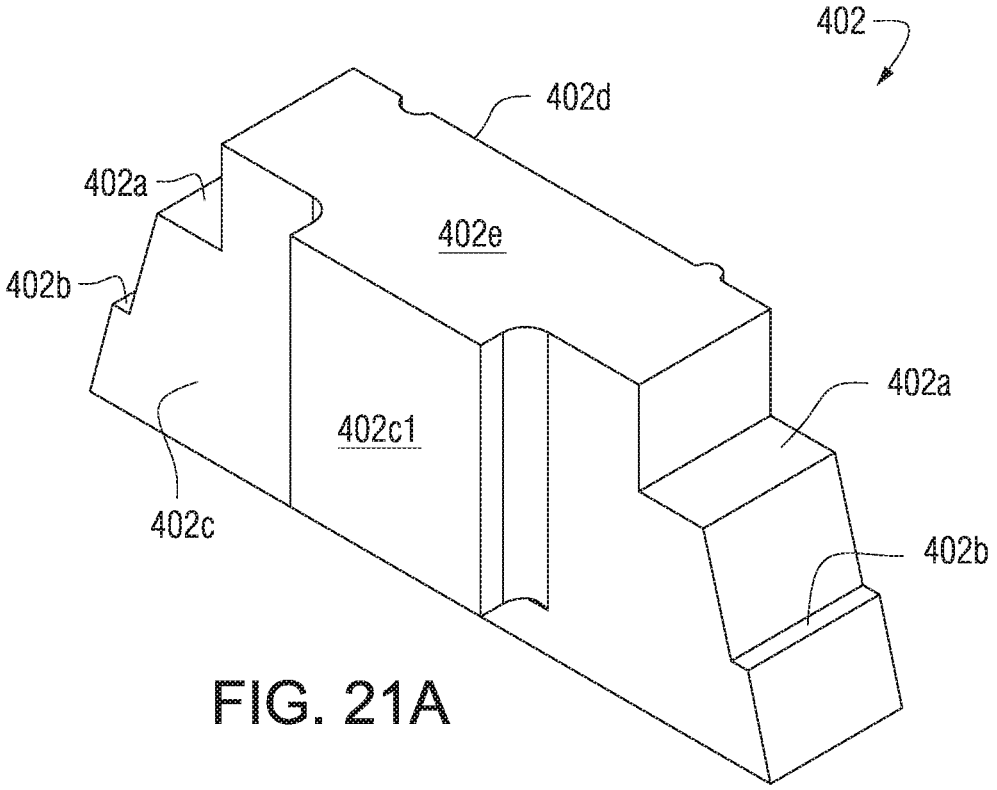
Figure 21B:
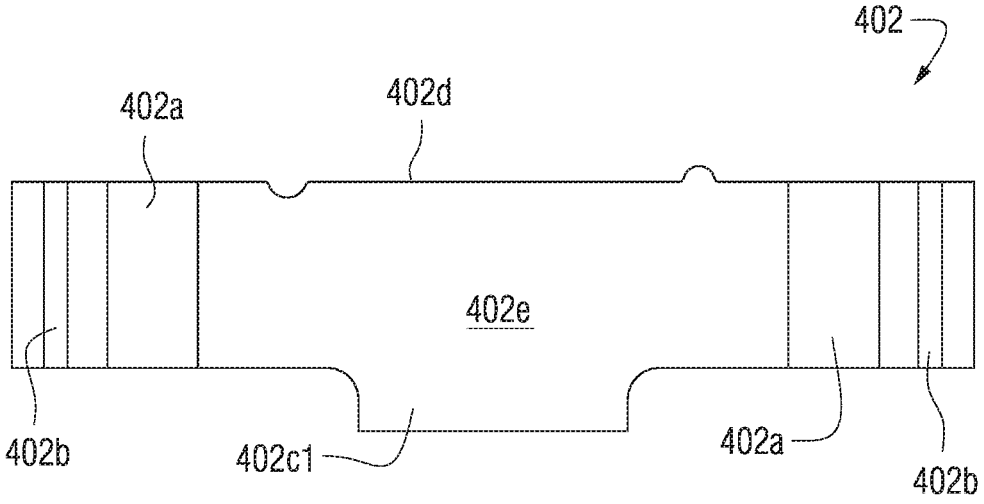
Figure 21C:
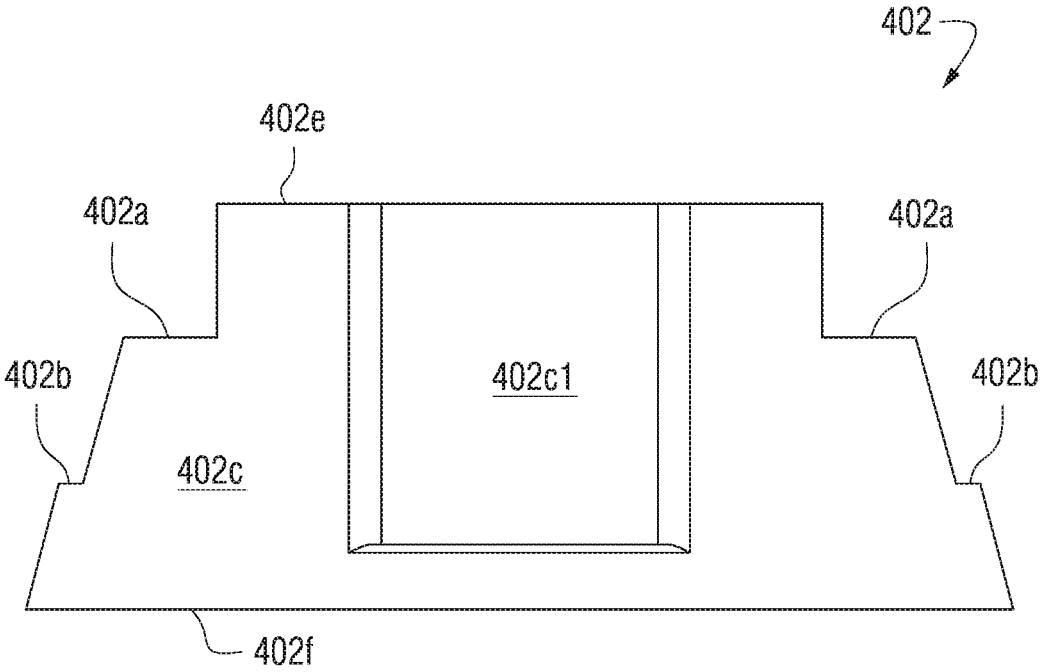
Figure 22A:
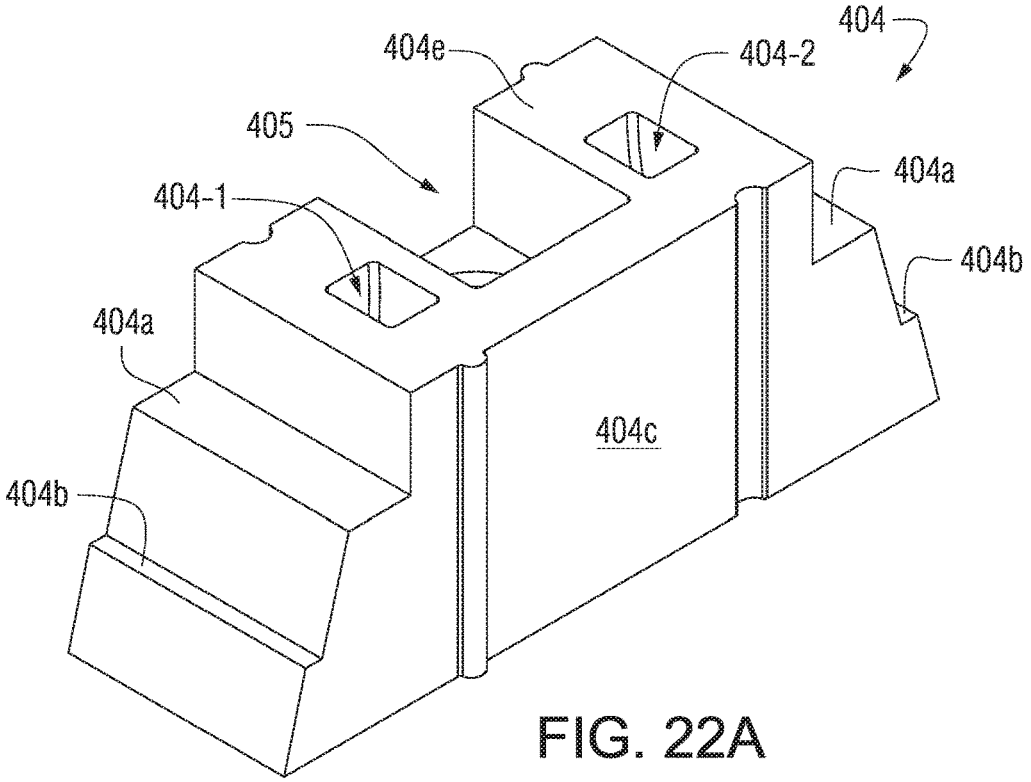
Figure 22B:
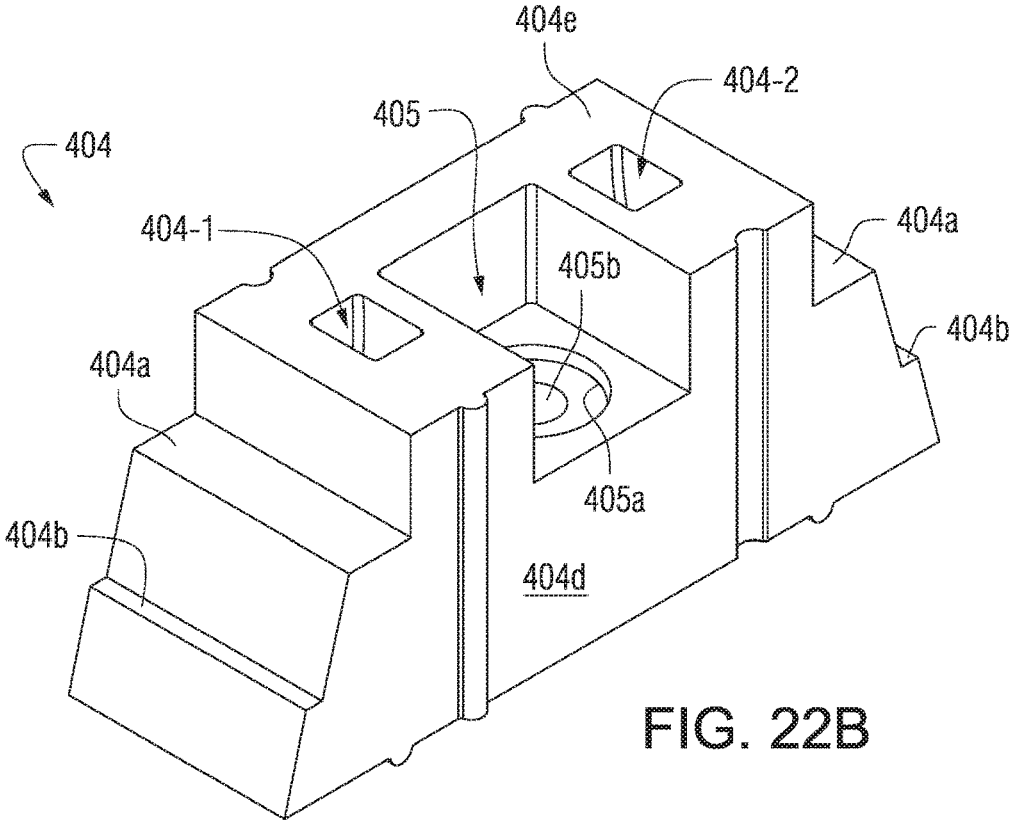
Figure 22C:
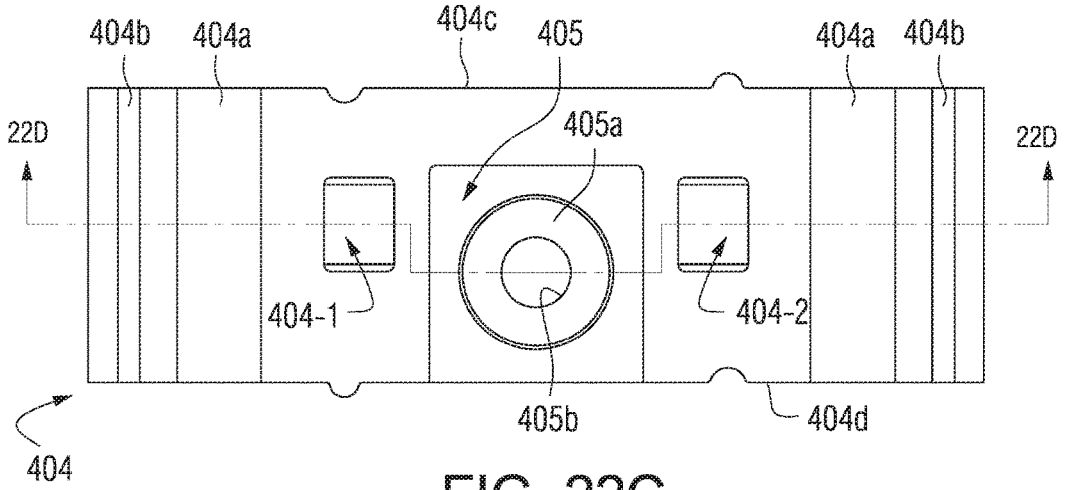
Figure 22D:
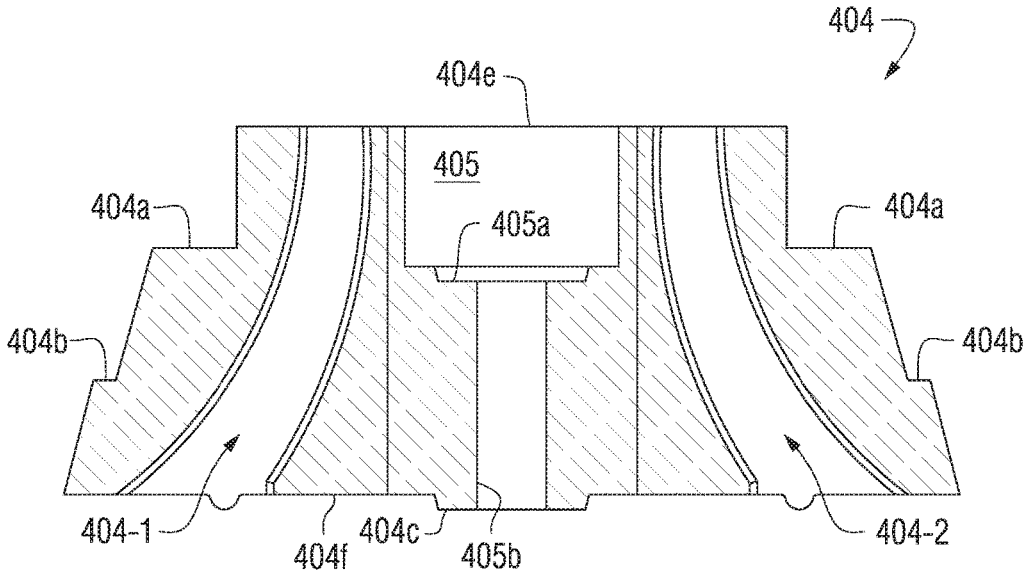
Figure 23A:
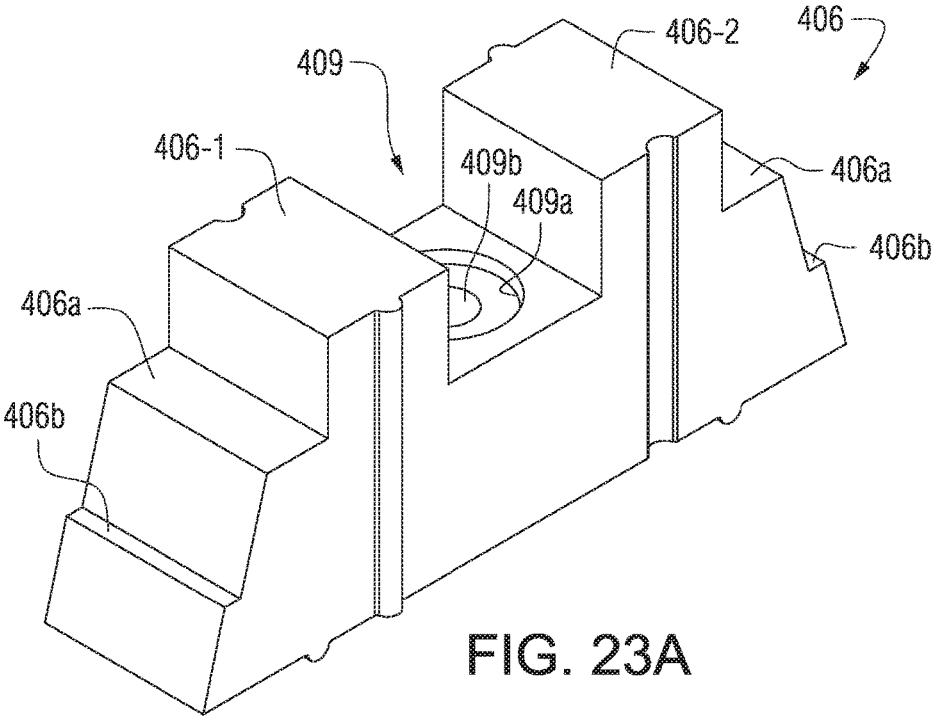
Figure 23B:
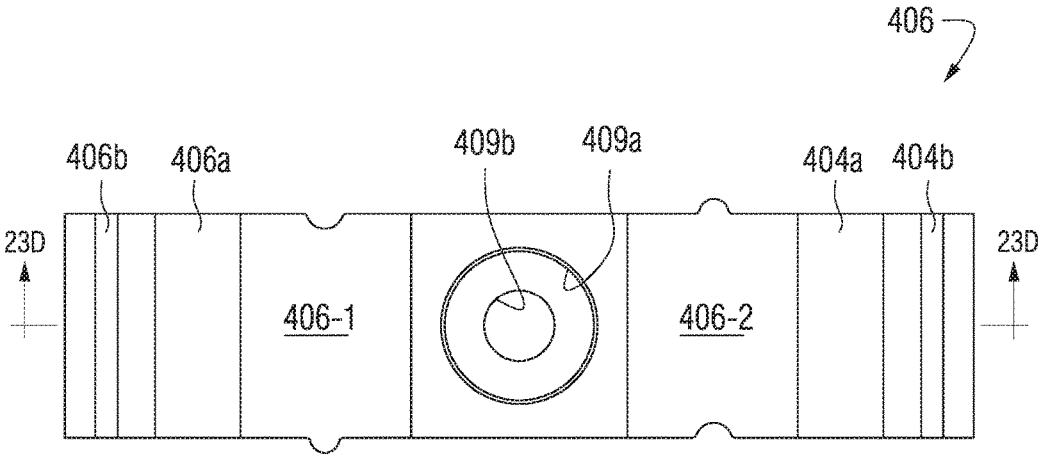
Figure 23C:
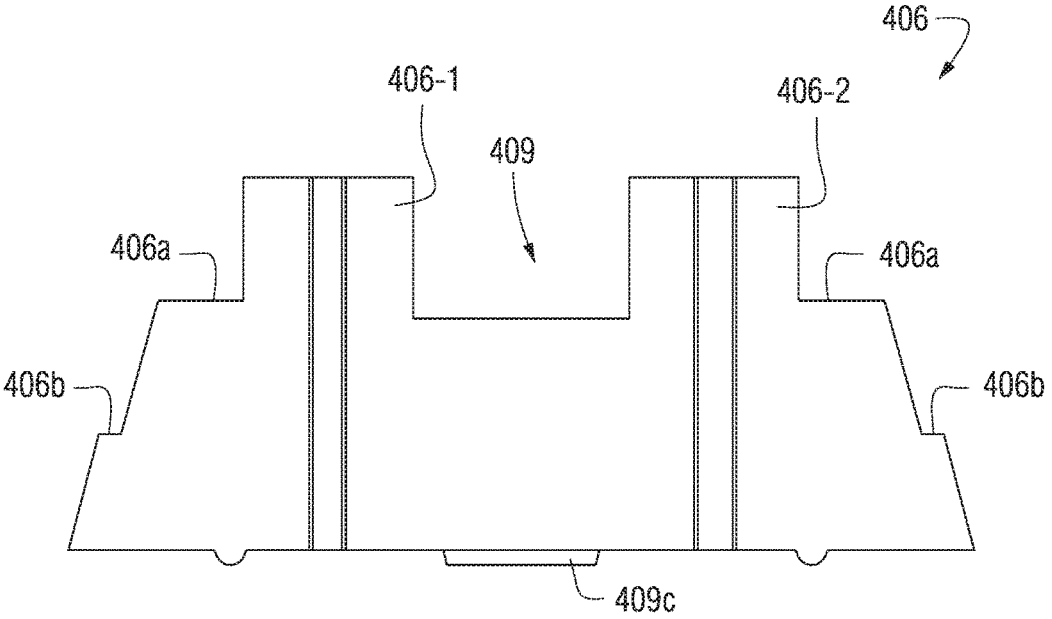
Figure 23D:
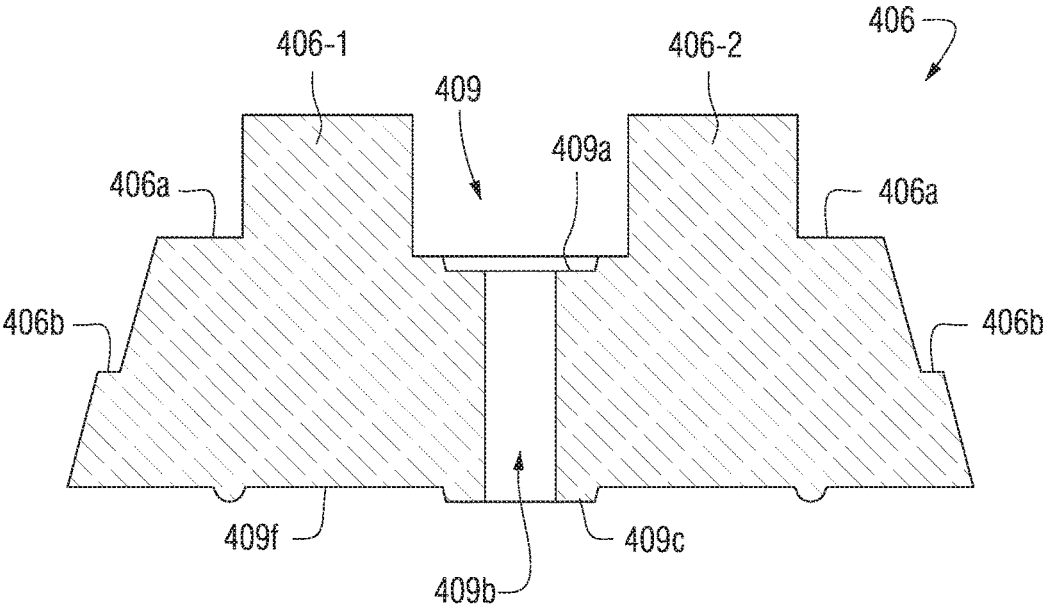
Figure 24A:
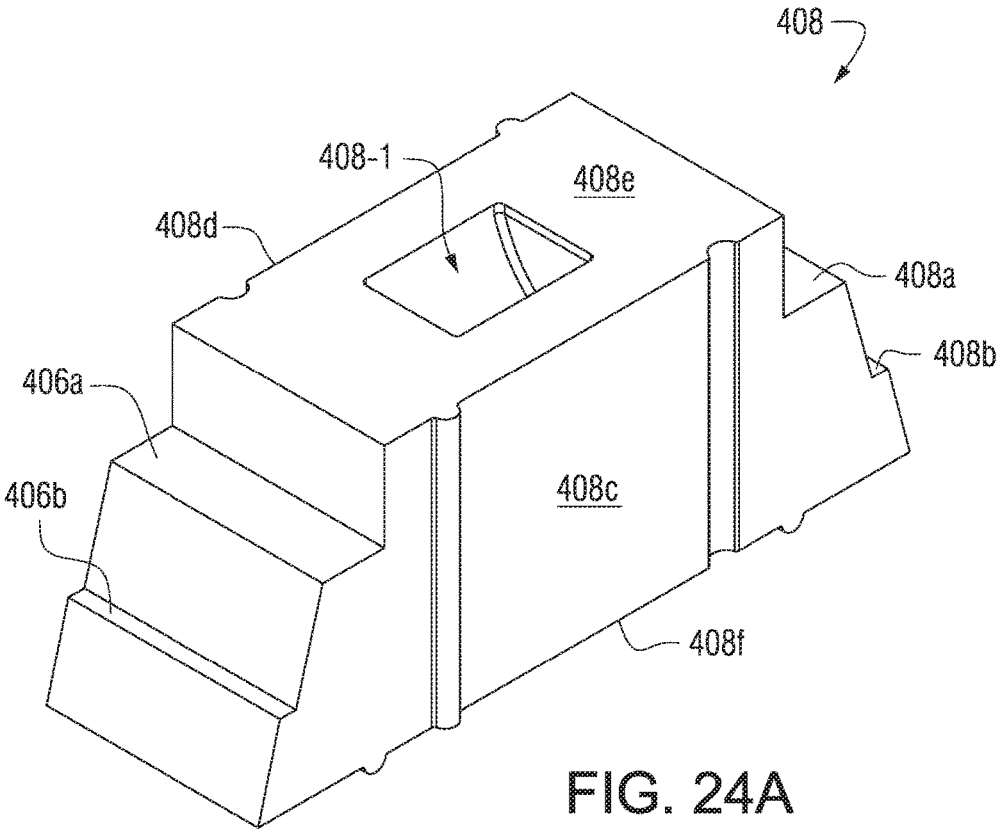
Figure 24B:
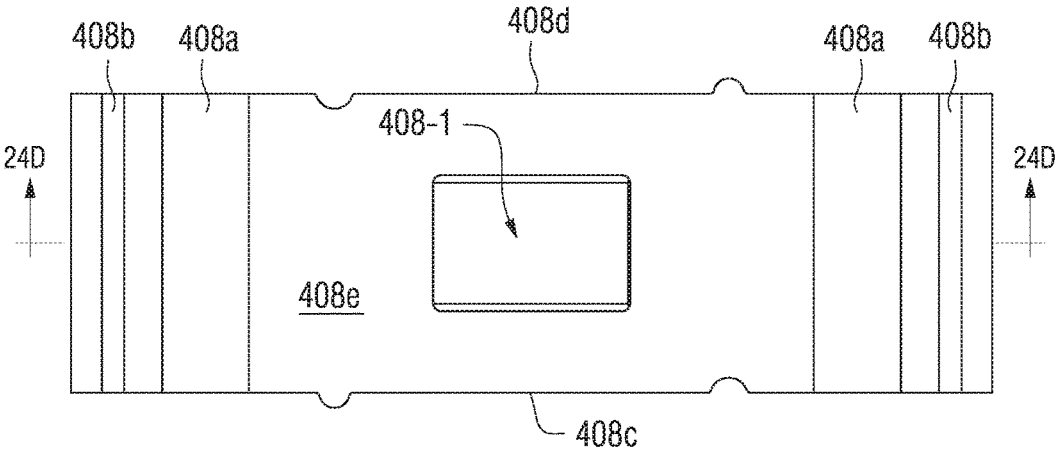
Figure 24C:
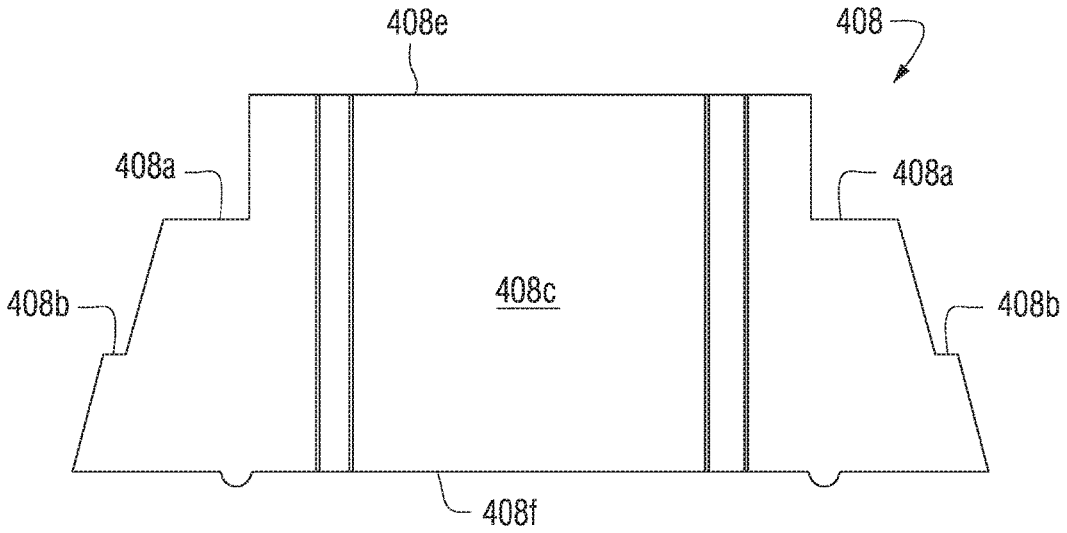
Figure 24D:
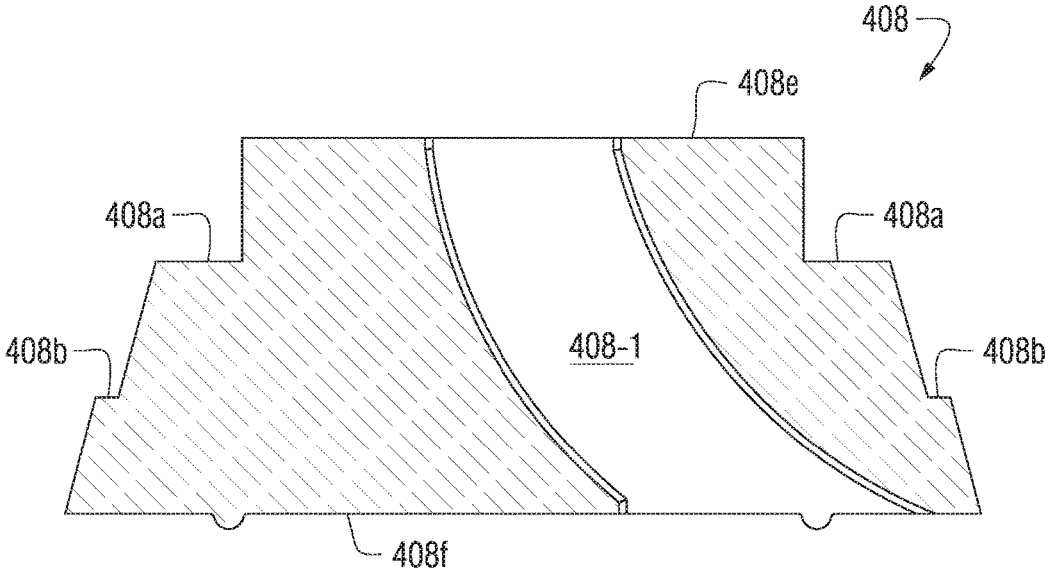
Figure 25A:
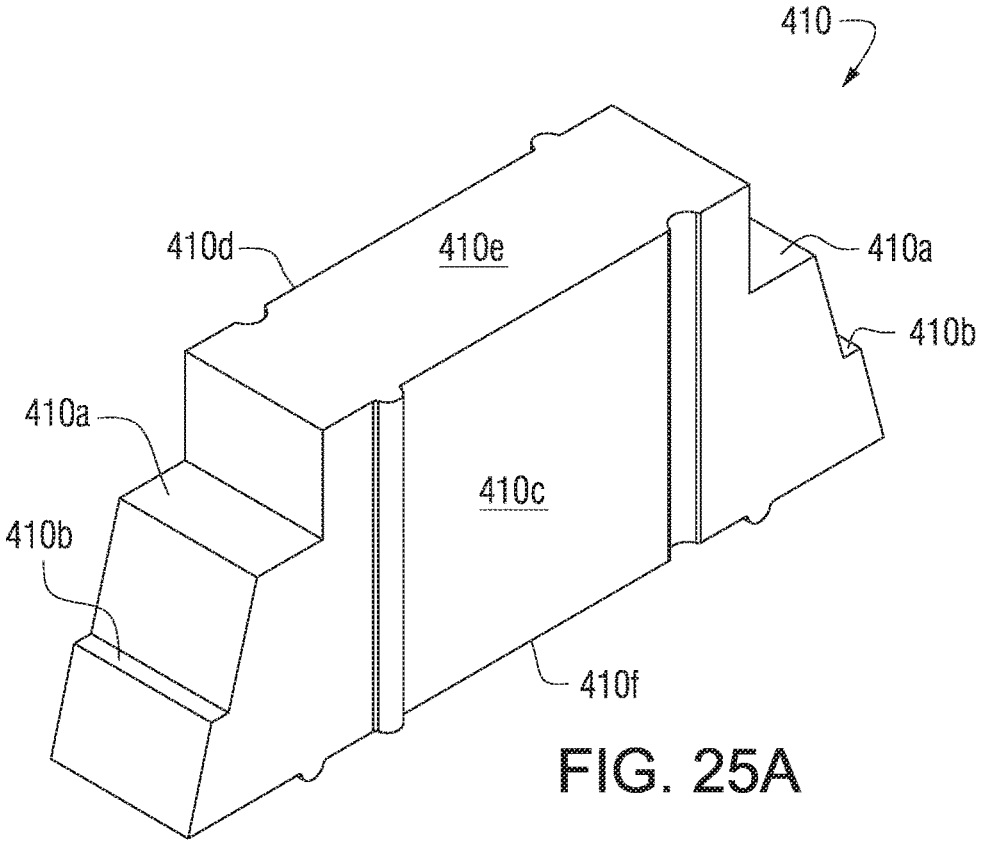
Figure 25B:
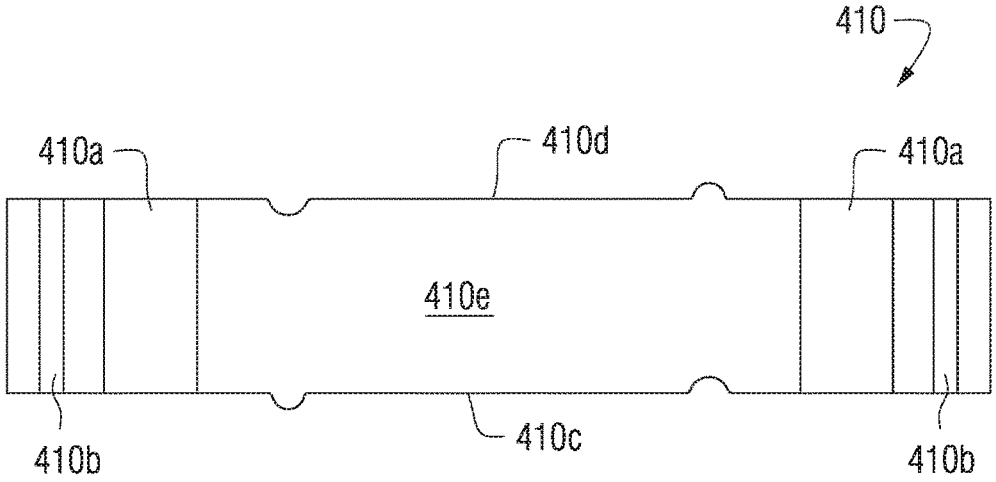
Figure 25C:
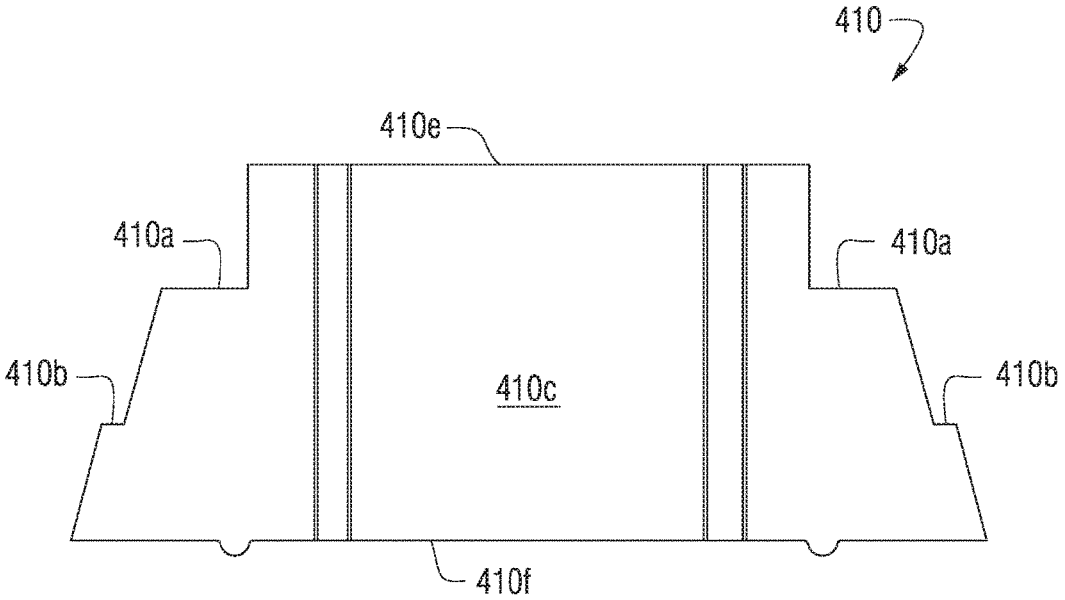
Figure 26A:
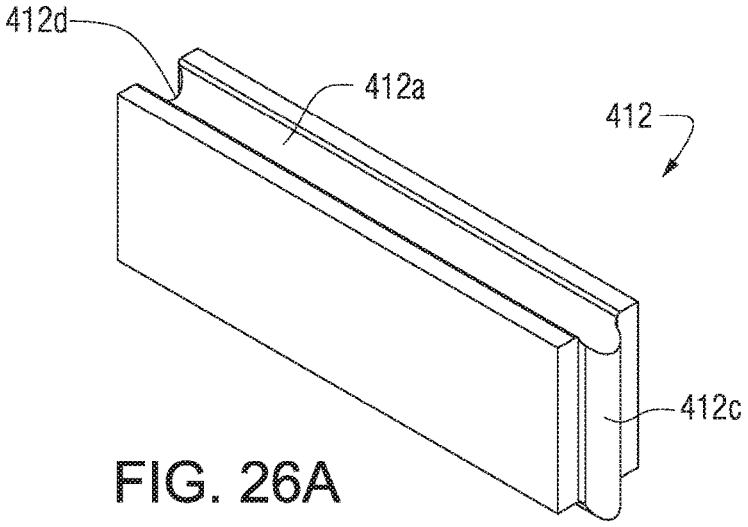
Figure 26B:
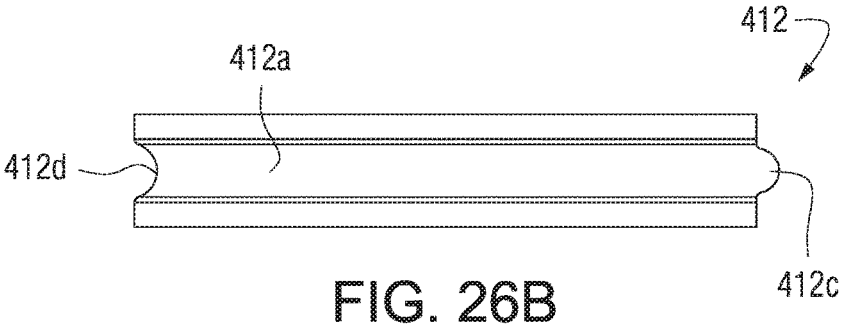
Figure 26C:
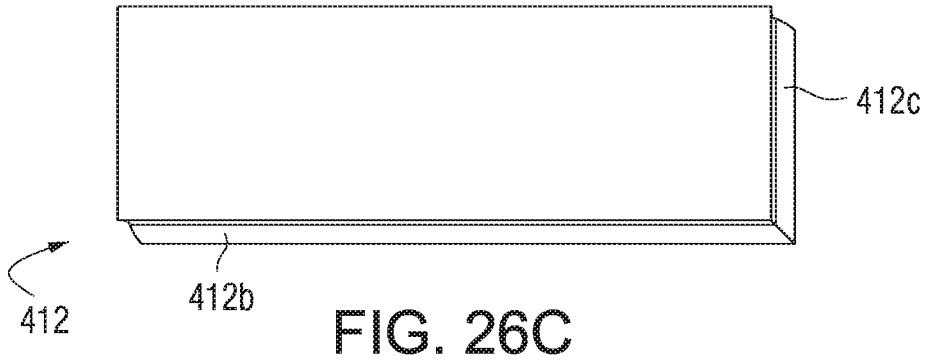
Figure 26D:
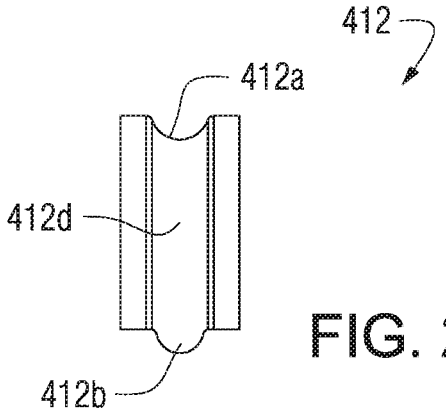
Figure 27A:
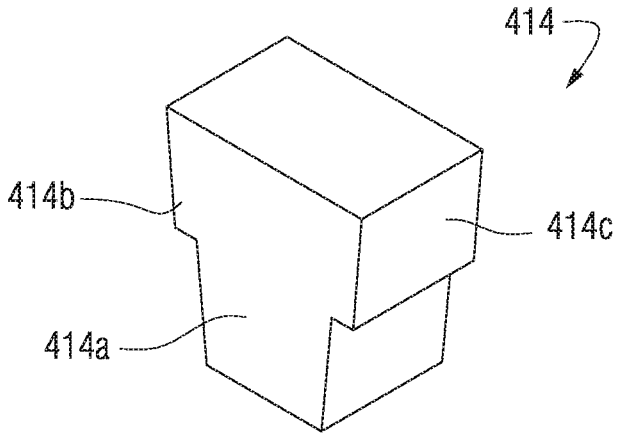
Figure 27B:
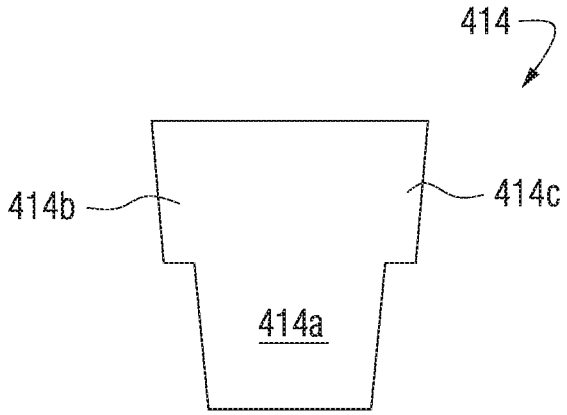
Figure 28A:
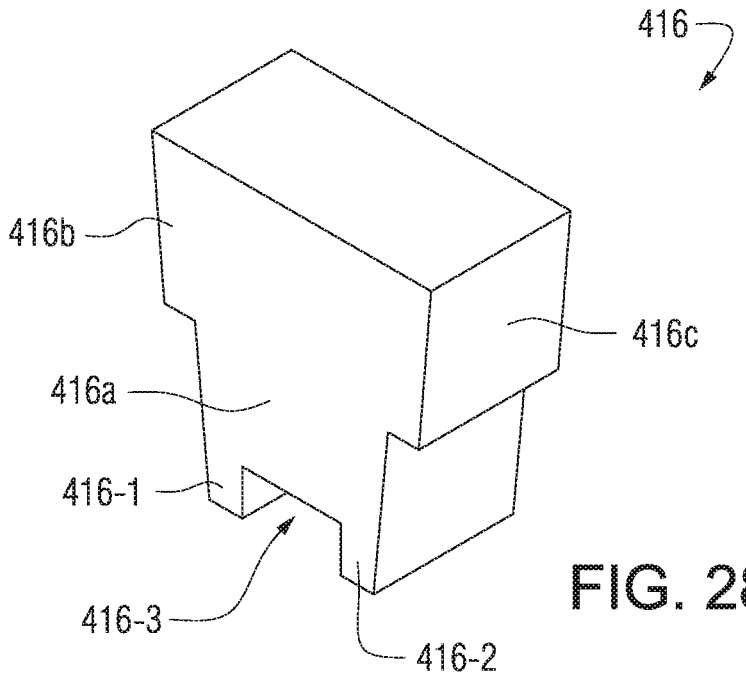
Figure 28B:
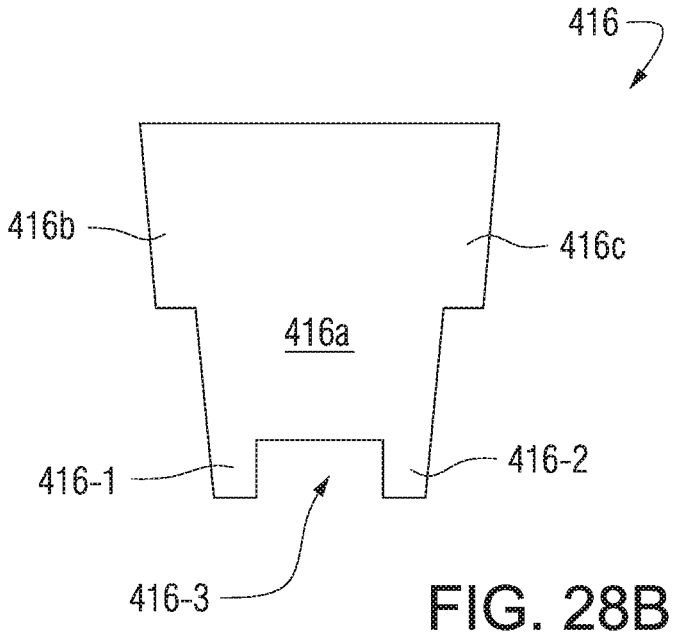
Figure 29A:
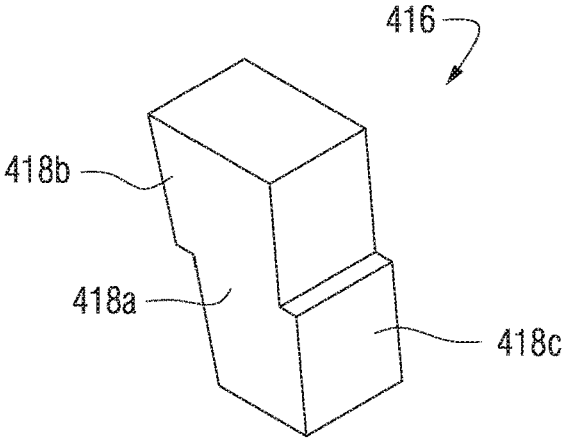
Figure 29B:
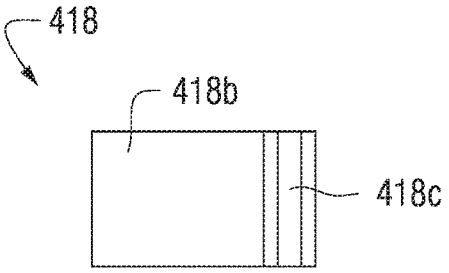
Figure 29C:
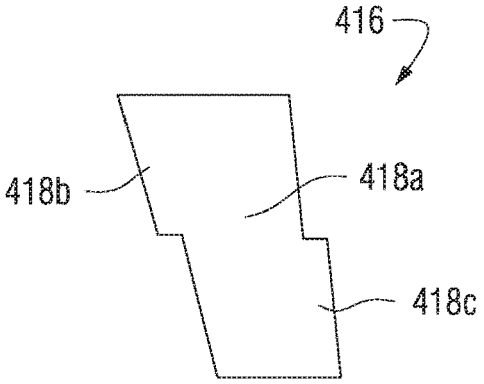

FIGS. 16A through 16D show a first type of central flue block providing both vertical and diagonally lateral flue sections associated with the third tier of blocks forming the corbel structure, wherein FIG. 16A is a perspective view thereof, FIG. 16B is a top plan view thereof, FIG. 16C is a front elevational view thereof, FIG. 16D is a latitudinal cross-sectional elevational view thereof taken along line 16D-16D in FIG. 16B;

FIGS. 17A through 17C show a diagonal flue block associated with the third tier of blocks forming the corbel structure, wherein FIG. 17A is a perspective view thereof, FIG. 17B is a top plan view thereof, and FIG. 17C is an end elevational view thereof;

FIGS. 18A through 18E show a second type of central flue block associated with the third tier of blocks forming the corbel structure, wherein FIG. 18A is a perspective view thereof, FIG. 18B is a top plan view thereof, FIG. 18C is a bottom plan view thereof, FIG. 18D is cross-sectional view thereof as taken along line 18D-18D in FIG. 18B, and FIG. 18E is an end elevational view thereof;

FIGS. 19A through 19C show a spacer block associated with the third tier of blocks forming the corbel structure, wherein FIG. 19A is a perspective view thereof, FIG. 19B is a top plan view thereof and FIG. 19C is a bottom plan view thereof;

FIG. 20 is an enlarged perspective assembled view of the fourth tier of blocks forming the corbel structure as viewed from above;

FIGS. 21A through 21C show an end block associated with the fourth tier of blocks forming the corbel structure, wherein FIG. 21A is a perspective view thereof, FIG. 21B is a top plan view thereof, and FIG. 21C is a front elevational view thereof;

FIGS. 22A through 22D show a first type of saddle block associated with the fourth tier of blocks forming the corbel structure, wherein FIG. 22A is a front perspective view thereof, FIG. 22B is a rear perspective view thereof; FIG. 22C is a top plan view thereof and FIG. 22D is a cross-sectional view thereof as taken along line 22D-22D of FIG. 22C;

FIGS. 23A through 23D show a second type of saddle block associated with the fourth tier of blocks forming the corbel structure, wherein FIG. 23A is a front perspective view thereof, FIG. 23B is a top plan view thereof, FIG. 23C is a front elevational view thereof and FIG. 23D is a cross-sectional view thereof as taken along line 23D-23D of FIG. 23C;

FIGS. 24A through 24D show a central diagonal flue block associated with the fourth tier of blocks forming the corbel structure, wherein FIG. 24A is a perspective view thereof, FIG. 24B is a top plan view thereof, and FIG. 24C is a front elevational view thereof, and FIG. 24D is a cross-sectional elevational view thereof as taken along line 24D-24D of FIG. 24C;

FIGS. 25A through 25C show a central spacer flue block associated with the fourth tier of blocks forming the corbel structure, wherein FIG. 25A is a perspective view thereof, FIG. 25B is a top plan view thereof, and FIG. 25C is a front elevational view thereof;

FIGS. 25A through 25D show an elongate upper edge block associated with the fourth tier of blocks forming the corbel structure, wherein FIG. 25A is a perspective view thereof, FIG. 25B is a top plan view thereof, FIG. 25C is a side elevational view thereof, and FIG. 25D is a front elevational view thereof;

FIGS. 27A and 27B 7G-2 depict a first type of central shelf block associated with the fourth tier of blocks forming the corbel structure, wherein FIG. 27A is a perspective view thereof and FIG. 27B is a front elevational view thereof;

FIGS. 28A and 28B depict a second type of central shelf block associated with the fourth tier of blocks forming the corbel structure, wherein FIG. 28A is a perspective view thereof and FIG. 28B is a front elevational view thereof; and FIGS. 29A through 29C depict a lateral shelf block associated with the fourth tier of blocks forming the corbel structure, wherein FIG. 29A is a perspective view thereof, FIG. 29B is a top plan view thereof, and FIG. 29C is a front elevational view thereof.

DETAILED DESCRIPTION

Figure 1:
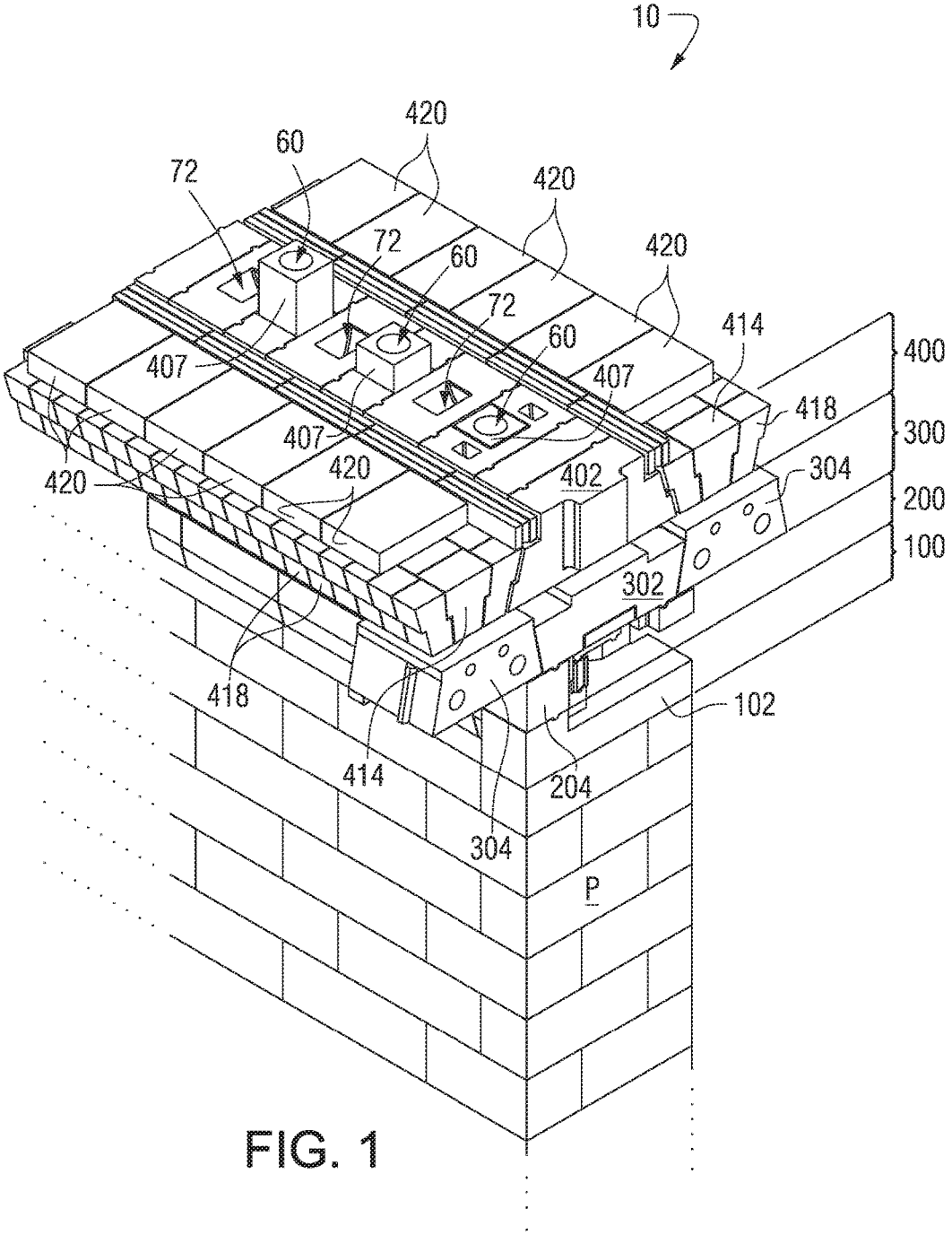
FIG. 1 is a perspective view showing an exemplary corbel structure in accordance with an embodiment of the present invention supported on a coke oven pier.
Figure 2:
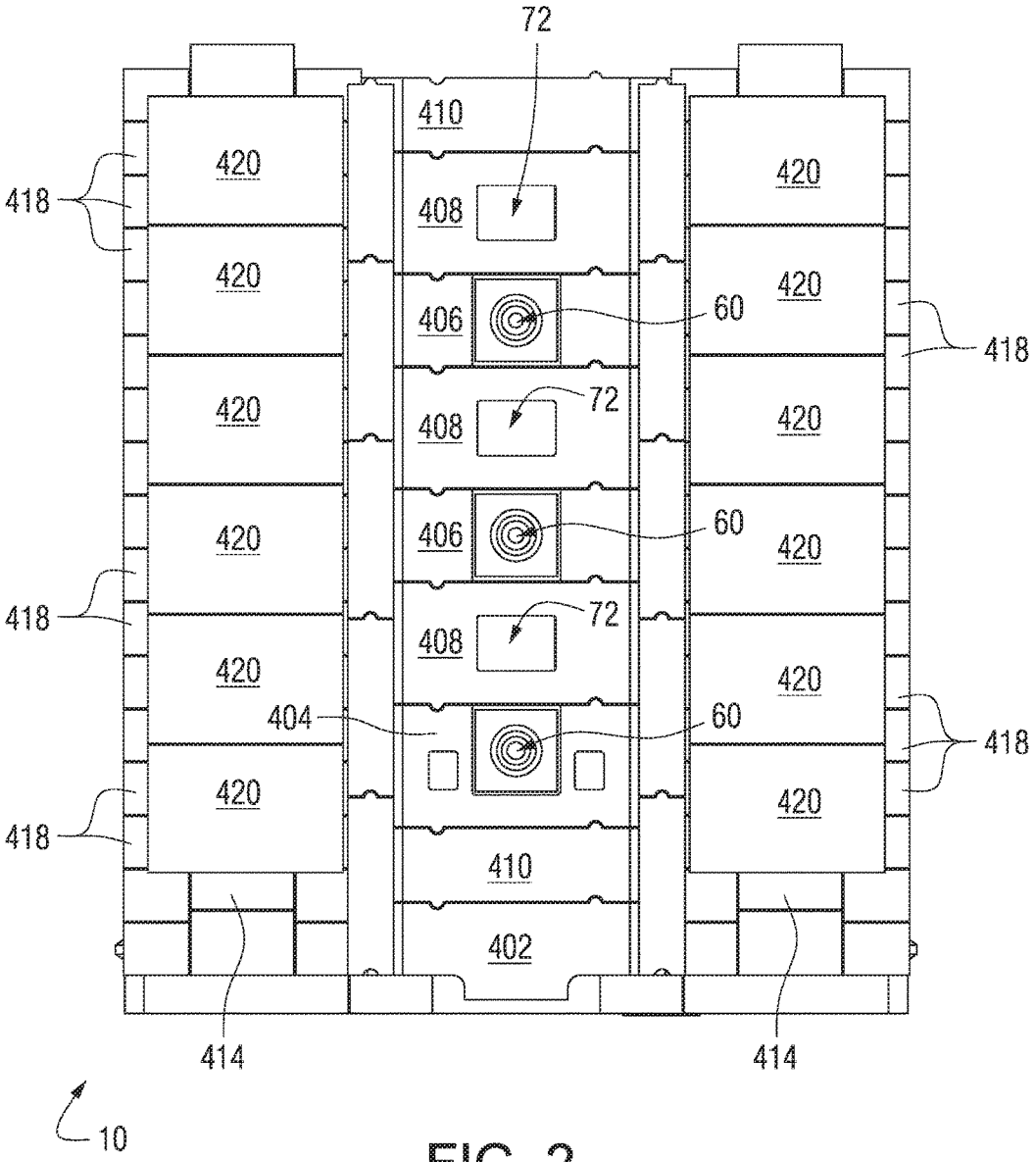
FIGS. 2 and 3 are top plan and front end elevational views, respectively, of the corbel structure shown in FIG. 1.
Figure 3:
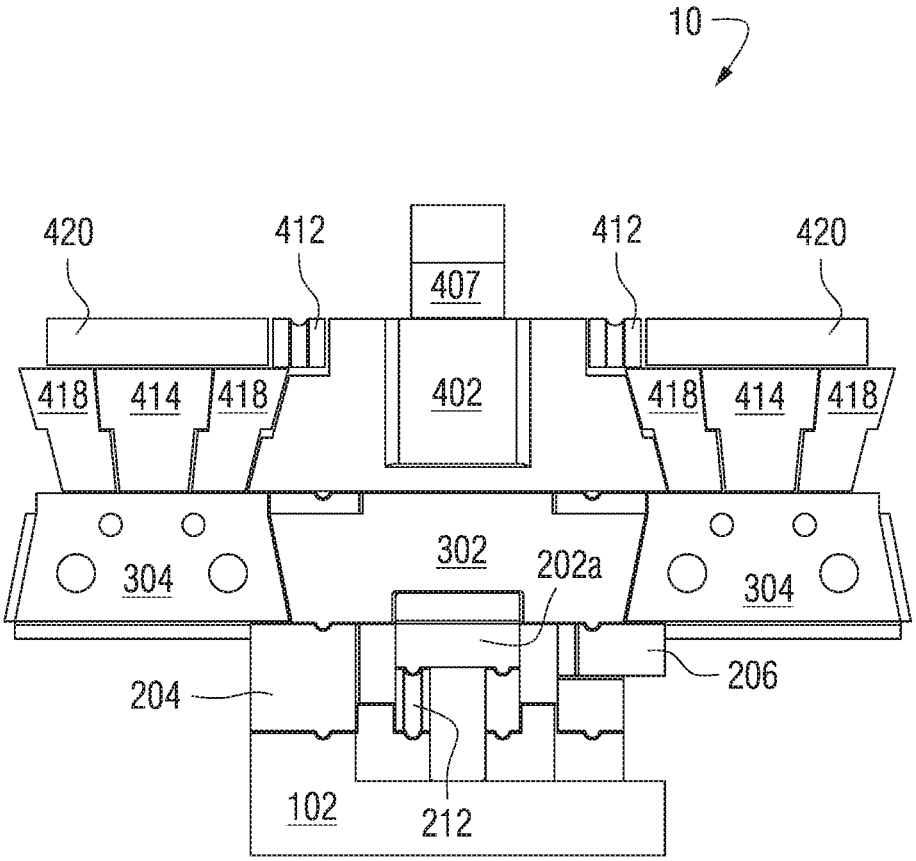

Accompanying FIGS. 1-3 shows an exemplary corbel structure 10 in accordance with an embodiment of the present invention supported on a pier P associated with a coke oven battery. In this regard, it will be understood that a conventional coke oven battery will include a number of spaced apart piers P, each supporting a corbel structure 10 and defining therebetween regenerator regions provided with checker bricks (not shown). The corbel structures 10 in turn support the refractory walls and floors of the individual coke ovens (not shown).

The corbel structure 10 is generally comprised of essentially four tiers 100, 200, 300 and 400 assembled from especially configured refractory blocks (to be described in greater detail below) which are stacked one on top of another. The tiers 100, 200, 300 and 400 collectively define central substantially vertically oriented flues 60 and lateral substantially diagonally oriented flues 72 which communicate with corresponding flues within the walls of the coke oven walls (not shown) to allow for the burning of air and gas therein and the transport of heated waste gas to and from the regenerator regions.

Figure 4:
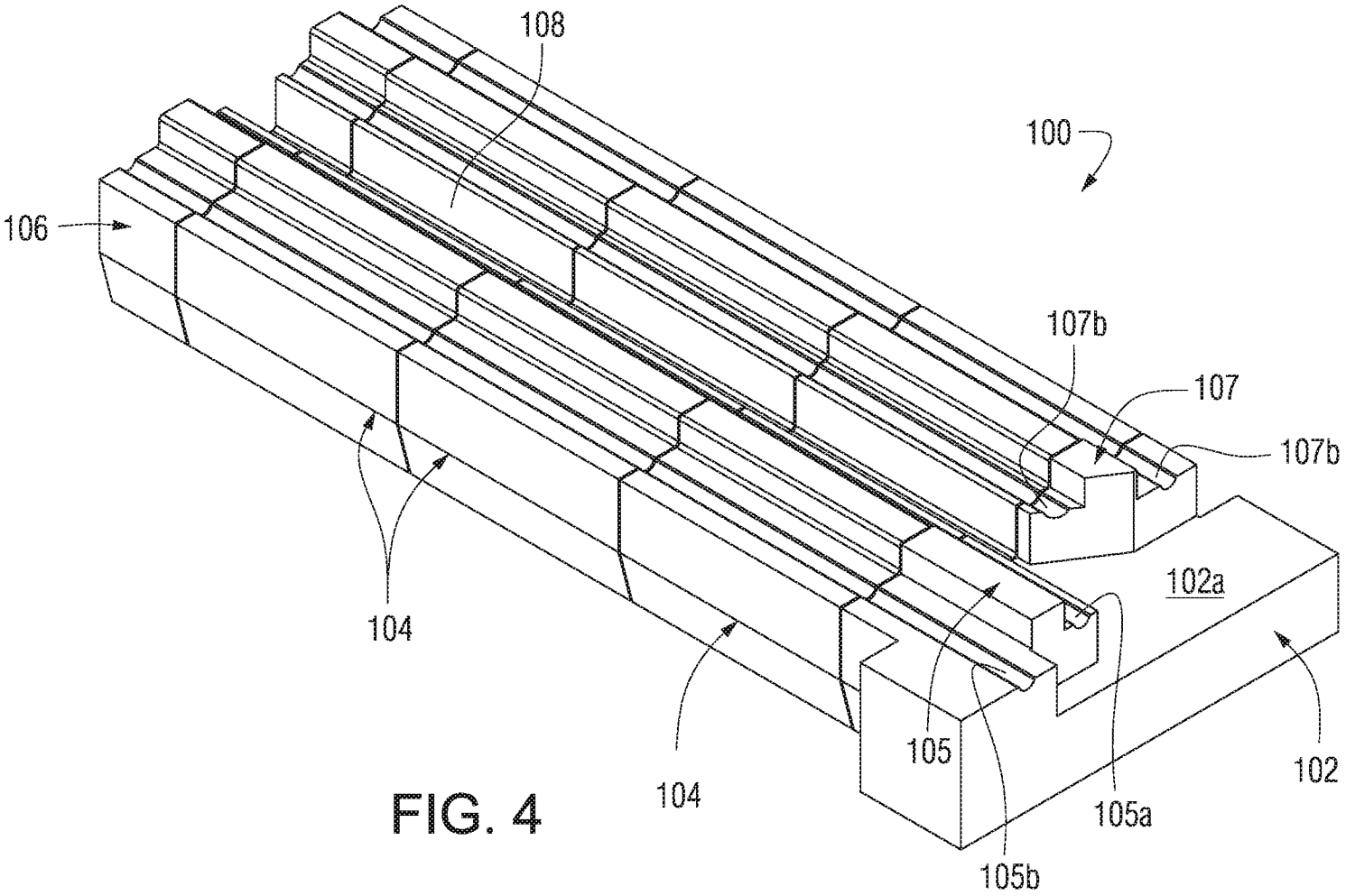
FIG. 4 is an enlarged perspective assembled view of the first tier of blocks forming the corbel structure shown in FIG. 1.

FIG. 4 is a perspective assembled view of the interconnected refractory blocks forming the first tier 100 of the corbel structure, with FIGS. 4A through 4I showing respective views of the individual refractory blocks thereof. In this regard, it will be observed that the first tier 100 of blocks is formed of an assembly of an end block 102 and first and second channel blocks 104, 106, respectively, forming an elongate substantially horizontal channel 108 to allow gas to flow from one end of the corbel structure 10 to the opposite end thereof.

Figure 4A:
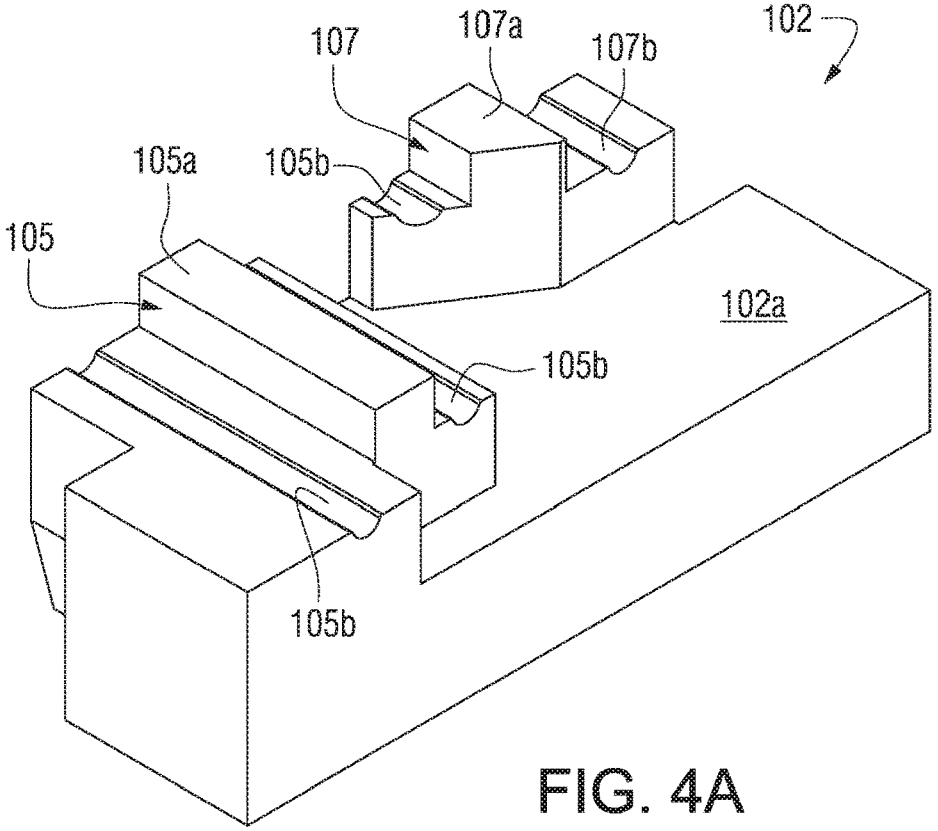
Figure 4B:
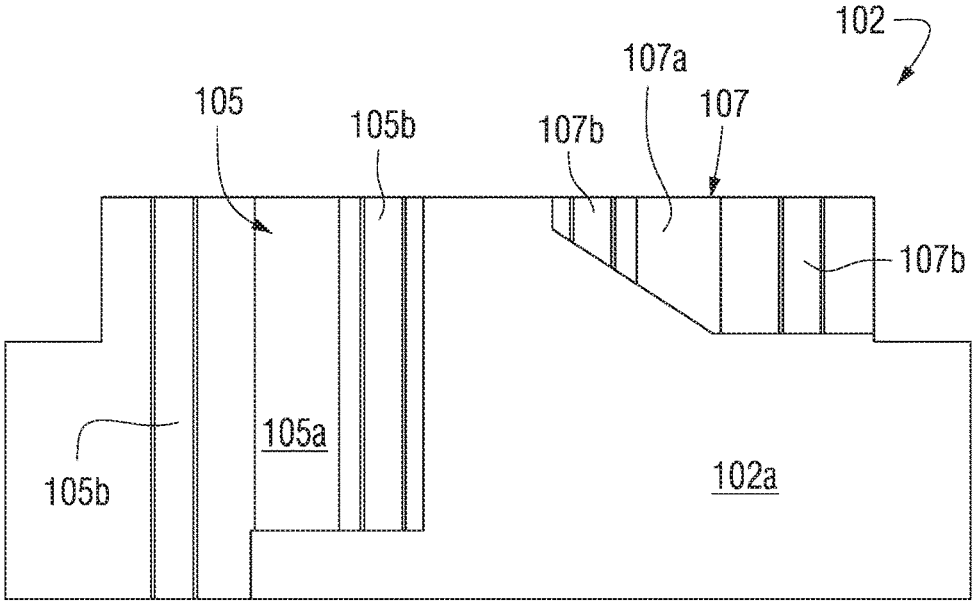
Figure 4C:
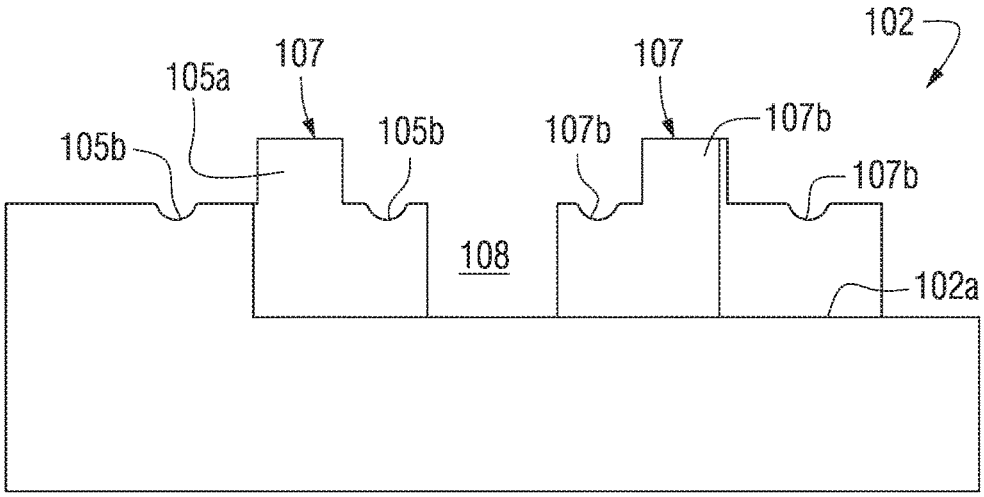

FIGS. 4A through 4C depict the end block 102 of the first tier 100. As shown, the end block 102 defines a substantially horizontal plateau surface 102*a* to allow a gas to enter into the channel 108 defined collectively by the assembled first and second channel blocks 104, 106, respectively. The end block 102 includes a latitudinally separated pair of raised profile sections 105, 107, respectively. The section 107 has a lesser dimension in the longitudinal direction of the block 102 as compared to the section 105 so as to establish a lateral inlet channel defined by the plateau surface 102*a* which fluid communicates with the longitudinal channel 108. Each of the sections 105, 107 includes a raised longitudinally oriented central ridge 105*a*, 107*a* positioned between a pair of longitudinally oriented U-shaped grooves 105*b*, 107*b*, respectively.

Figure 4D:
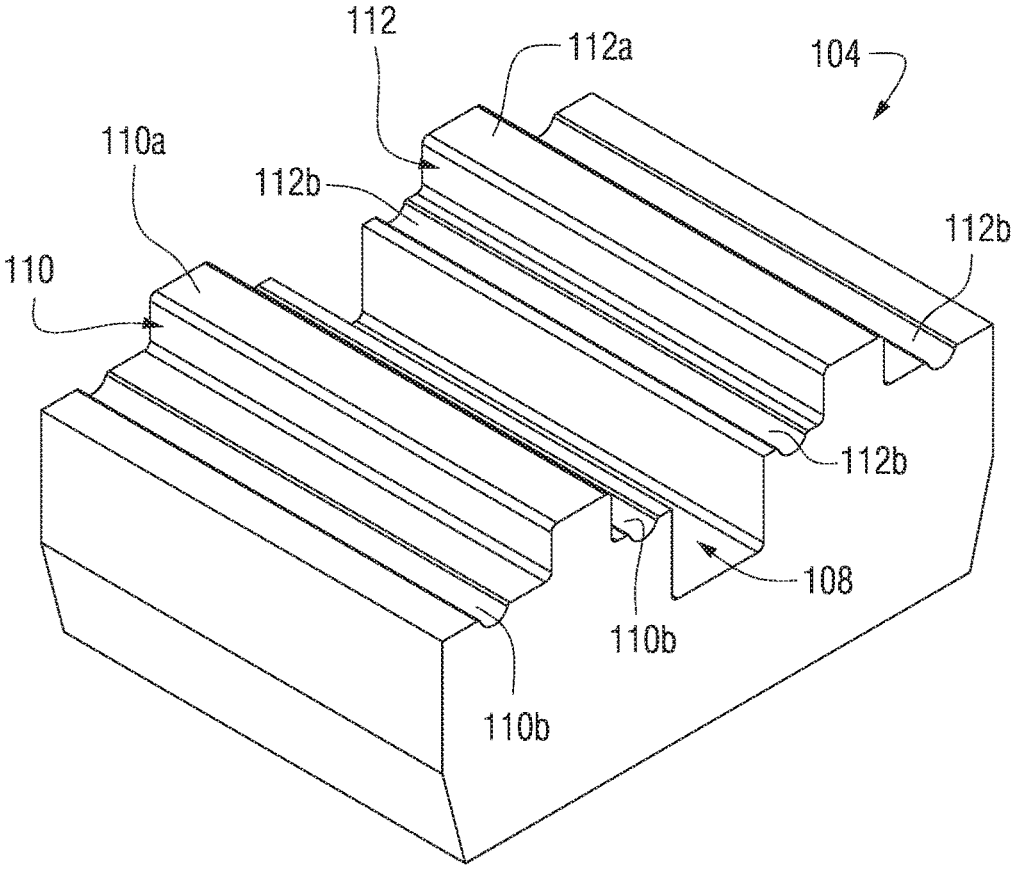
Figure 4E:
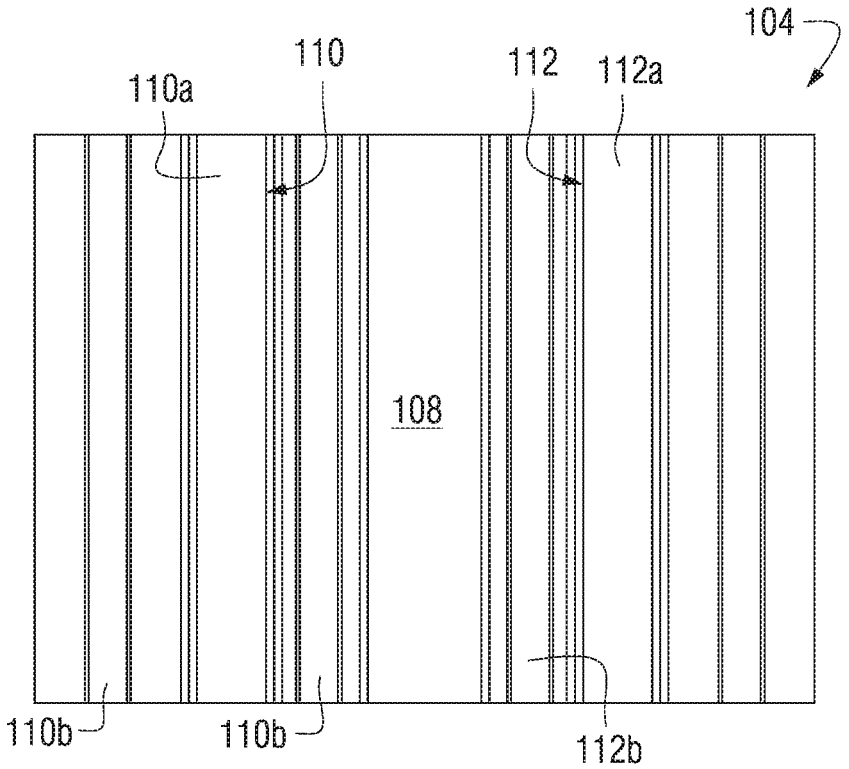
Figure 4F:
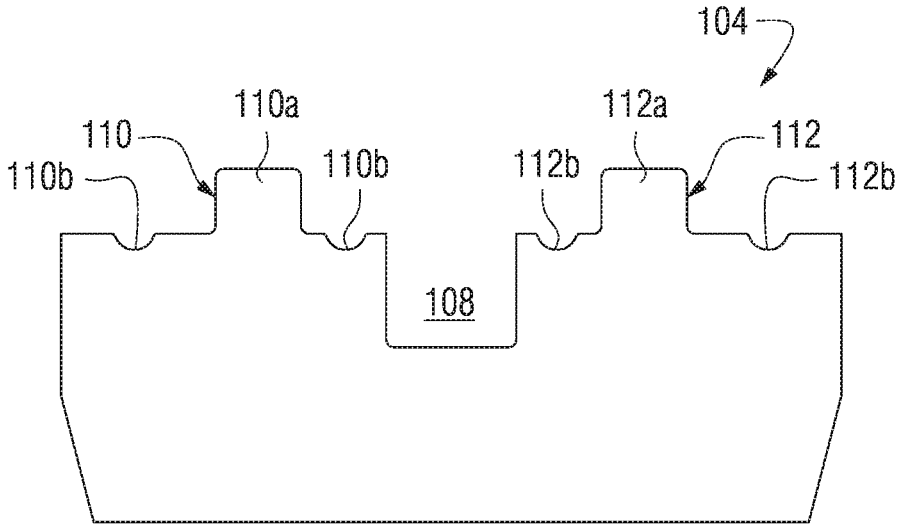

A representative one of the first channel blocks 104 is depicted in FIGS. 4D through 4F. As is seen by comparing the front profiles of the elevational views of FIGS. 4F and 4C, the latter defines the same upper surface profile as the latter. Thus, the block 104 will include a central longitudinally oriented section of the channel 108 positioned between a pair of opposed longitudinally oriented raised profile sections 110, 112. Each of the sections 110, 112 includes a raised longitudinally oriented central ridge 110*a*, 112*a* positioned between a pair of longitudinally oriented U-shaped grooves 110*b*, 112*b*, respectively, which as noted above are longitudinally coincident with the ridges 105*a*, 107*a* and the grooves 105*b*, 107*b*, respectively.

Figure 4G:
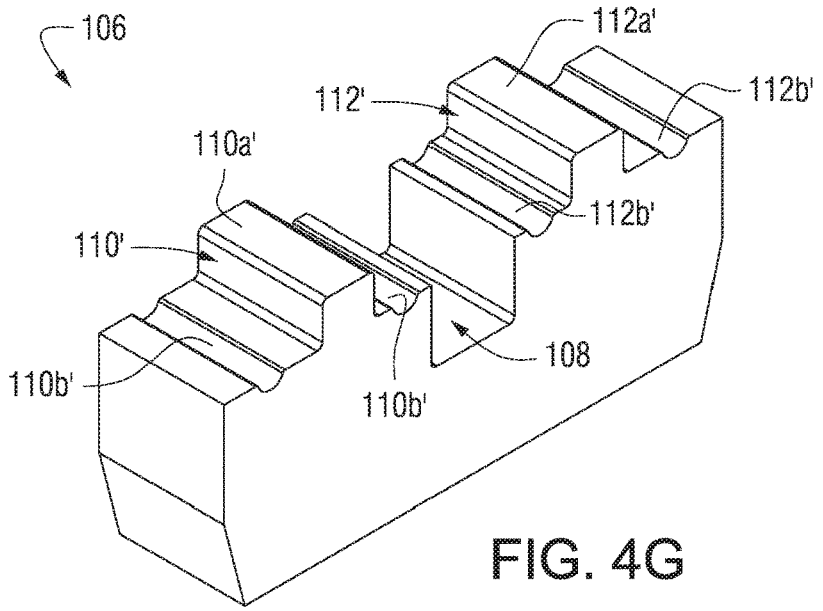
Figure 4H:
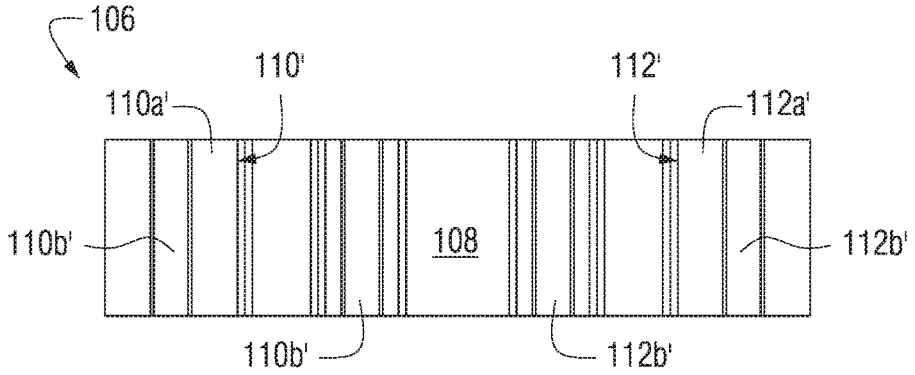
Figure 4I:
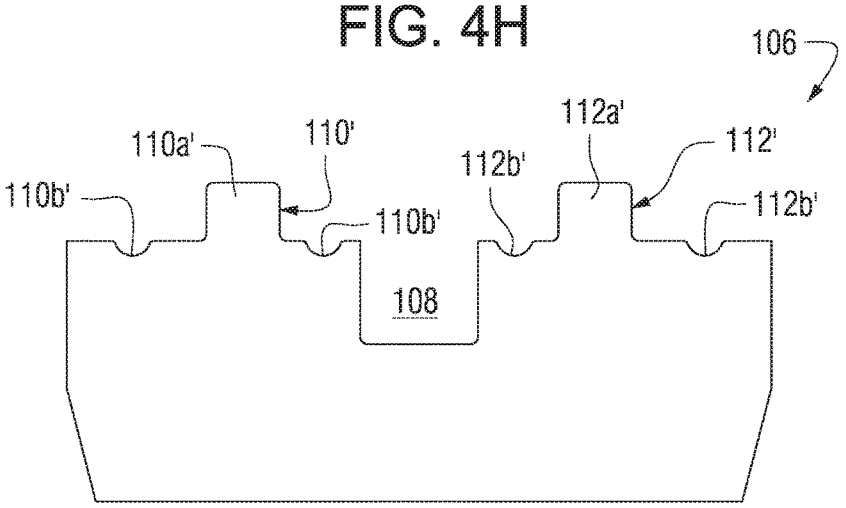

The second type of channel block 106 shown by FIG. 4G through 4I is substantially identical to the block 104 as describe previously with a principal exception being that the dimension as measured in the longitudinal direction of the first tier 100 of blocks is less as compared to the same dimension of the second type of channel block 104. Thus, the relative thickness of the block 106 is less as compared to the block 104 thereby enabling the blocks 104 and 106 to be assembled adjacently as may be needed to accommodate varying longitudinal dimensional requirements for the first tier 100 of blocks associated with the corbel structure 10. Thus, similar structural components of the block 106 have been identified with the same reference numeral as those employed for block 104 with an added prime (') designation.

Figure 5A:
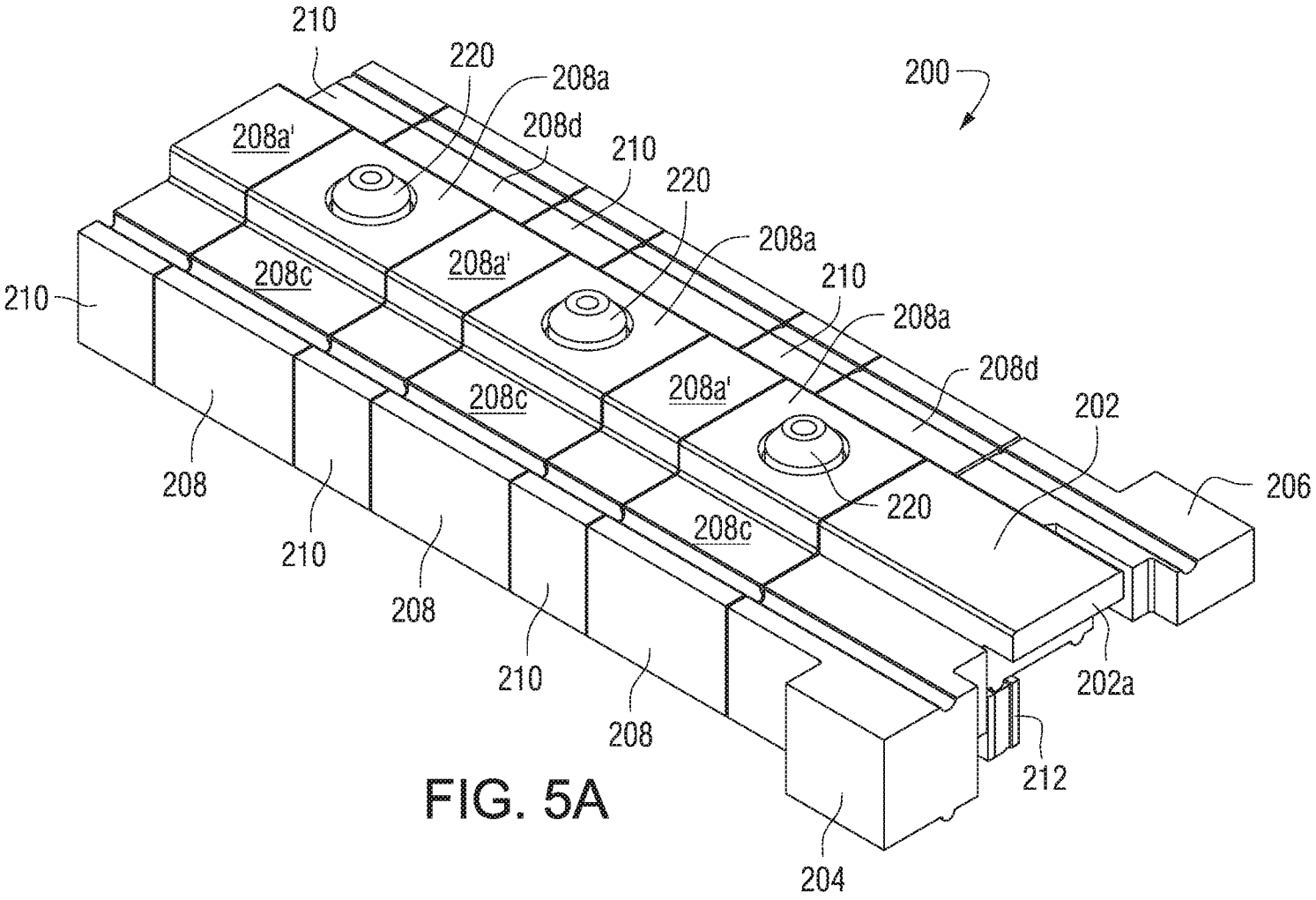
FIG. 5A is an enlarged perspective assembled view of the second tier of blocks forming the corbel structure as viewed from above.
Figure 5B:
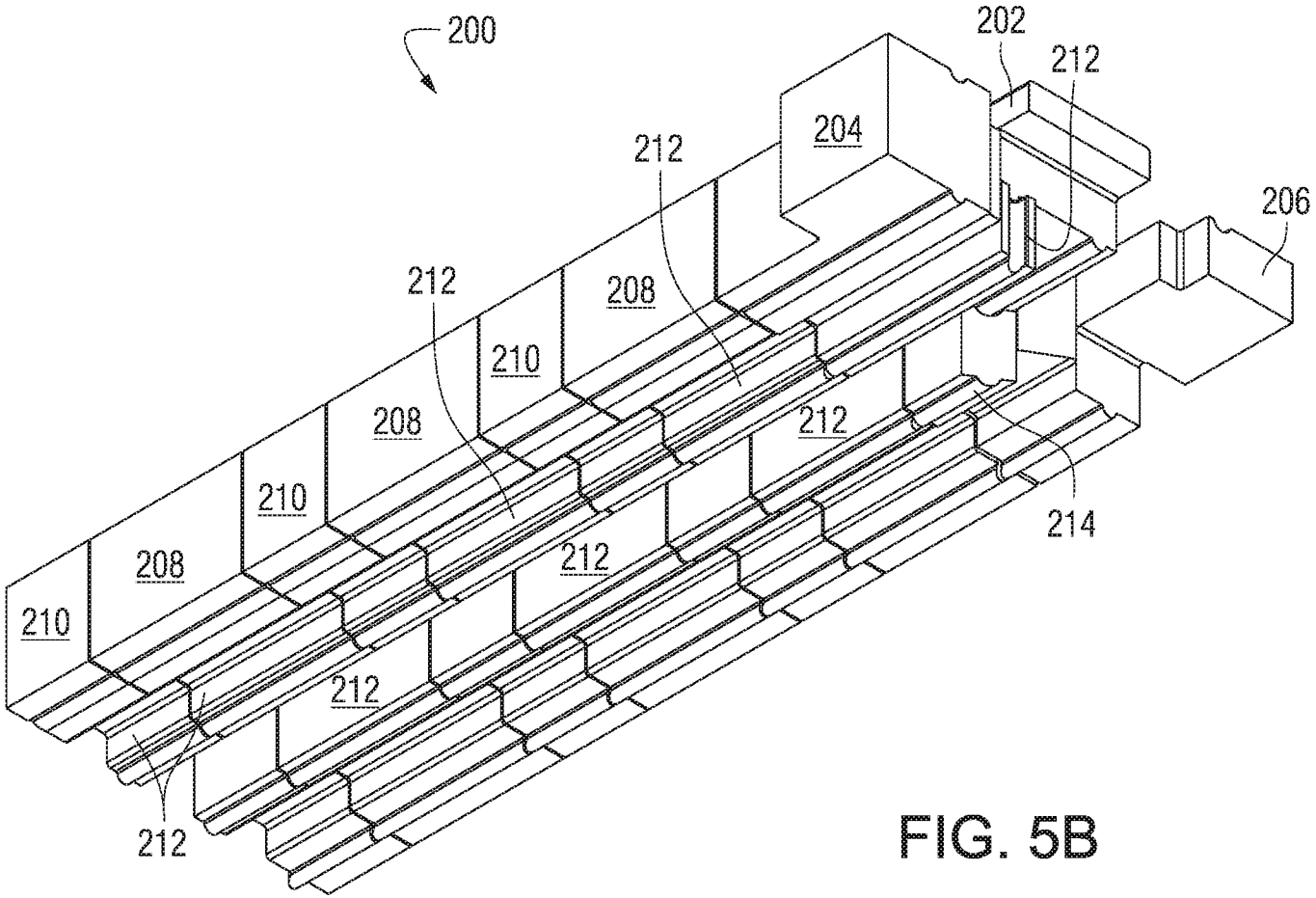
FIG. 5B is an enlarged perspective assembled view of the second tier of blocks depicted in FIG. 5A as viewed from below.
Figure 6A:
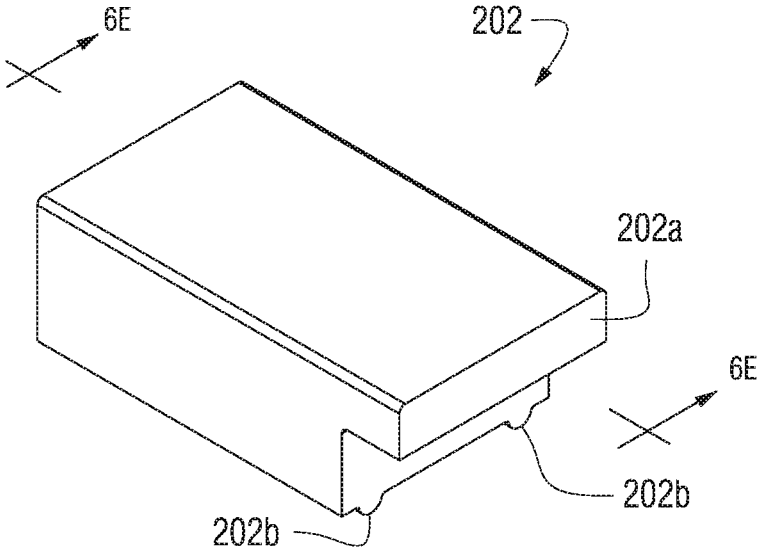
Figure 6B:
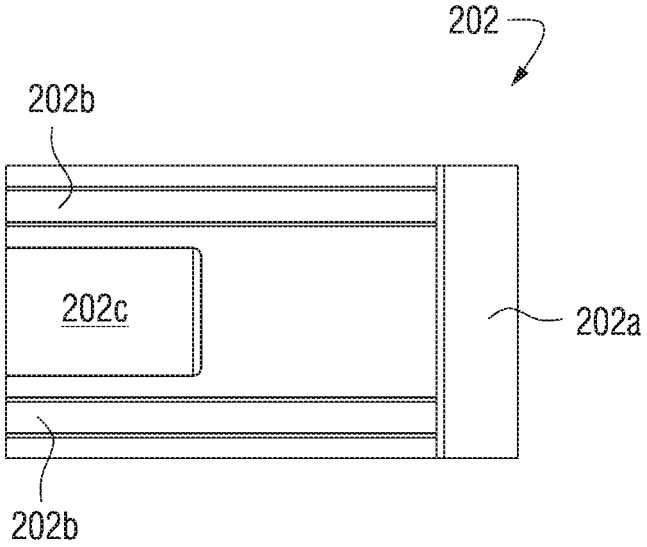
Figure 6C:
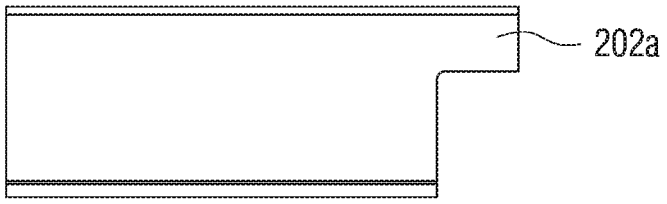
Figure 6D:
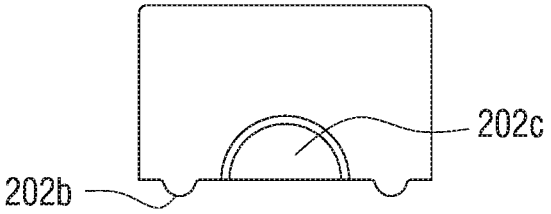
Figure 6E:
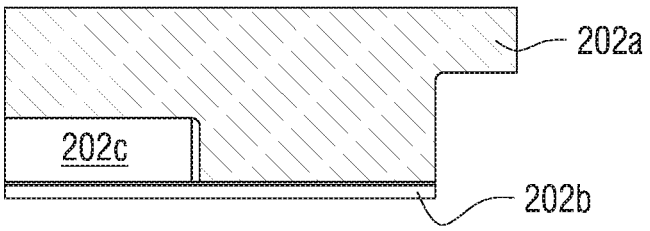
Figure 7A:
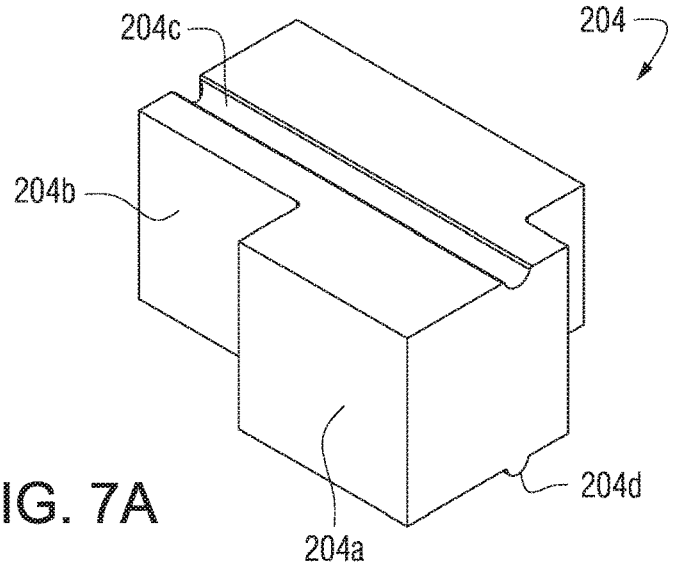
Figure 7B:
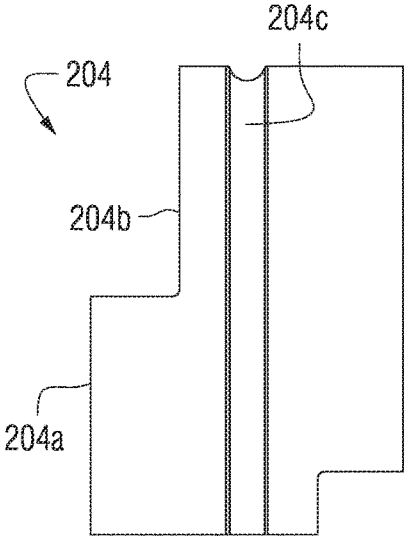
Figure 7C:
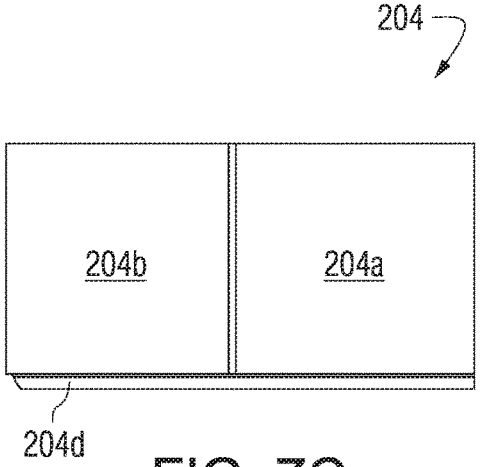
Figure 7D:
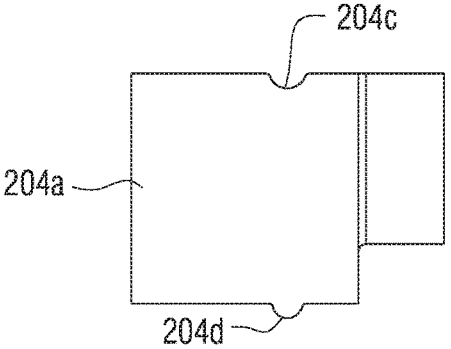
Figure 8A:
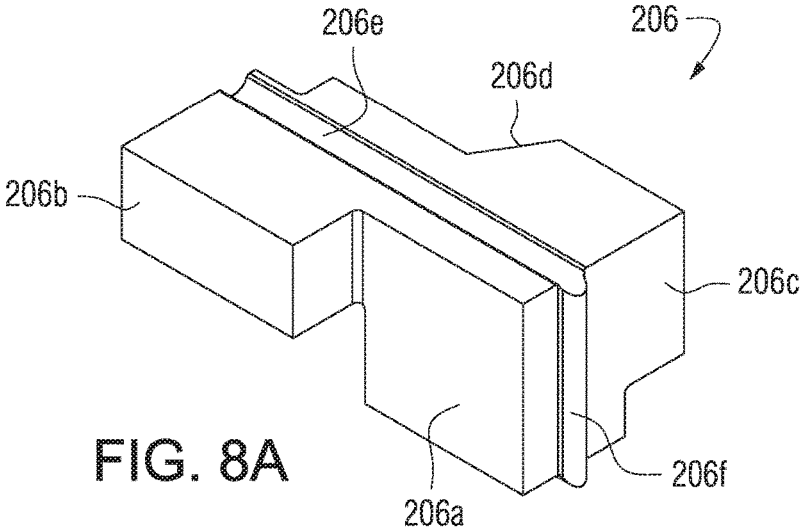
Figure 8B:
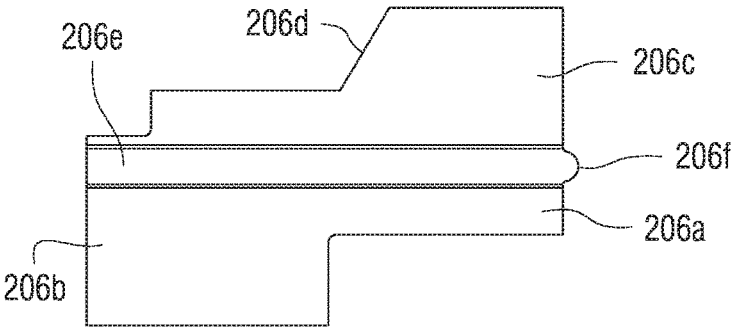
Figure 8C:
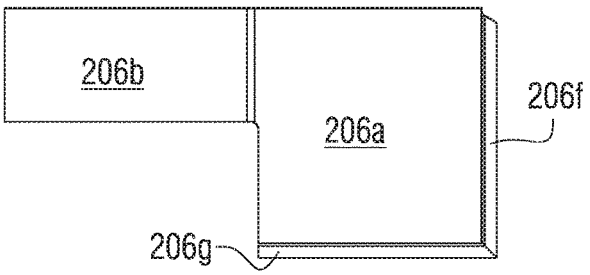
Figure 8D:
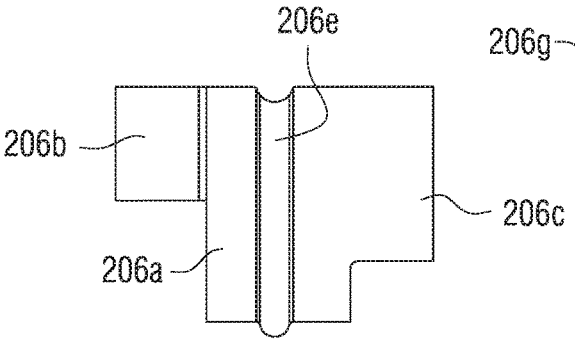
Figure 9A:
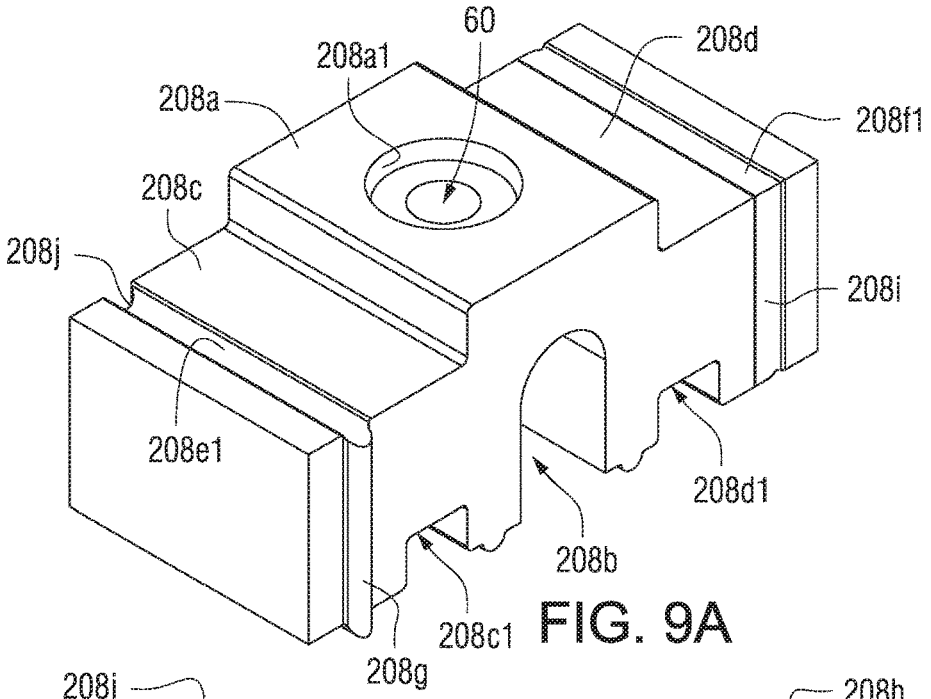
Figure 9B:
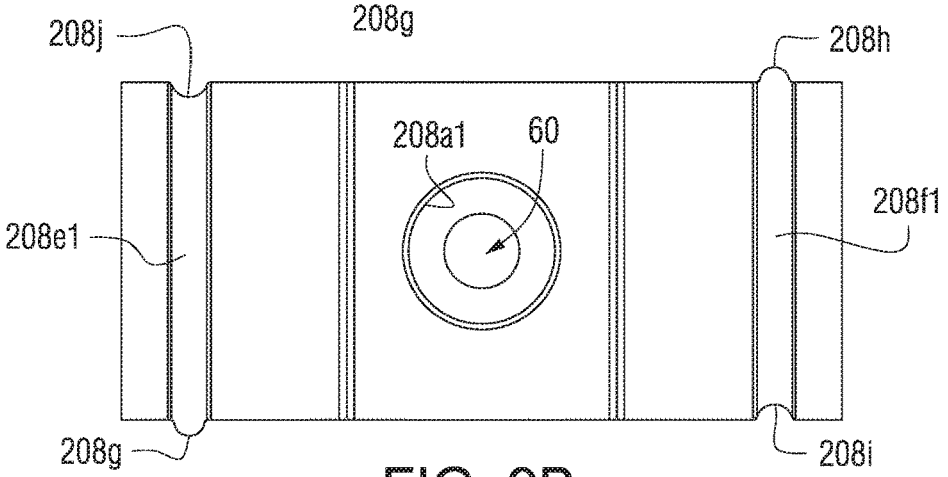
Figure 9C:
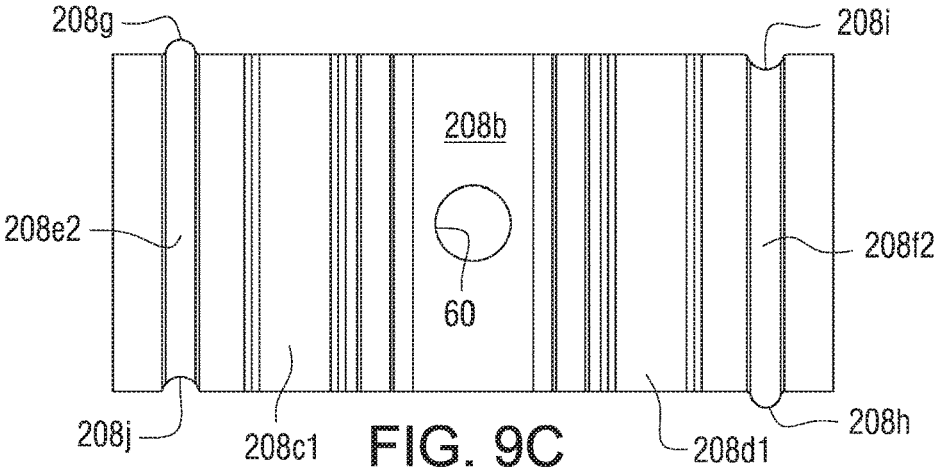
Figure 9D:
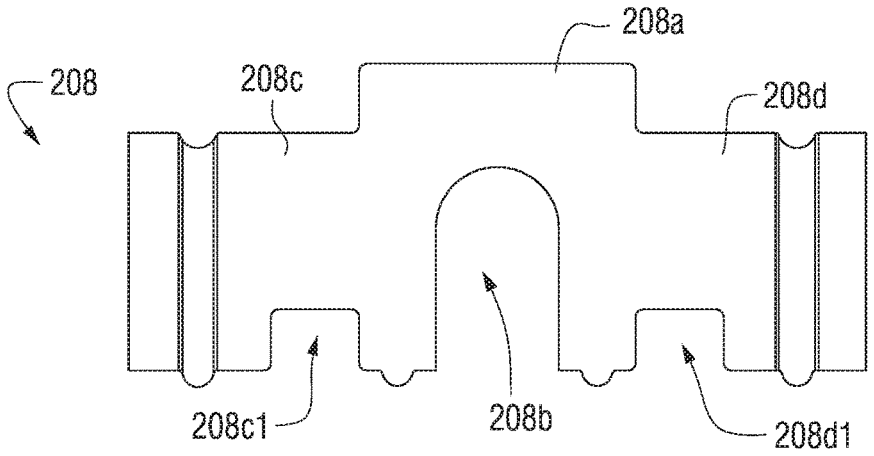
Figure 10A:
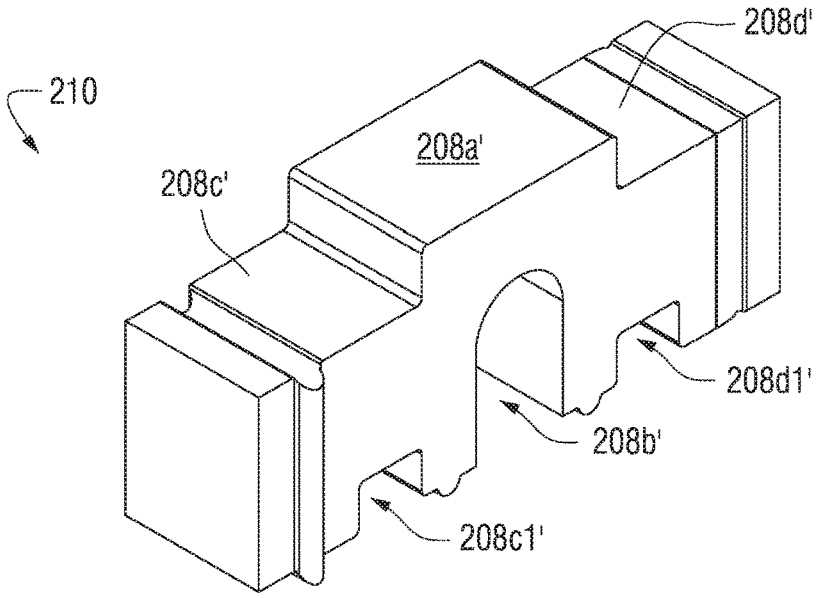
Figure 10B:
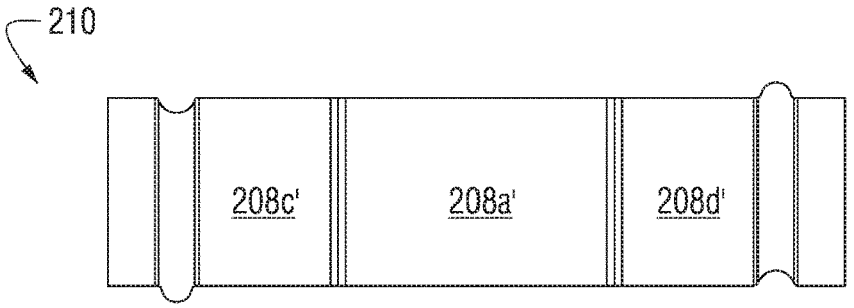
Figure 10C:
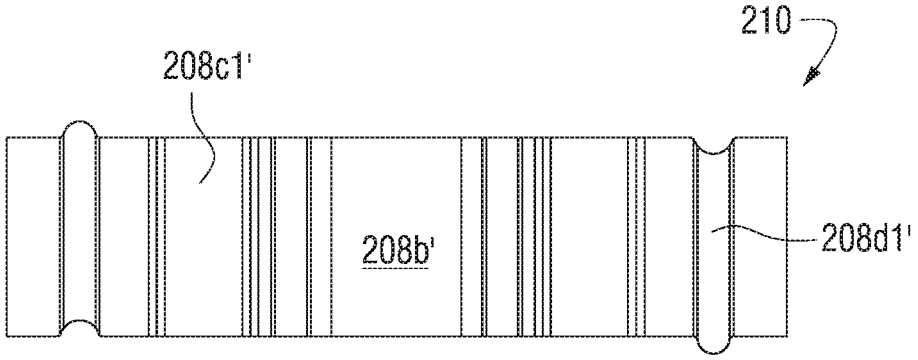
Figure 10D:
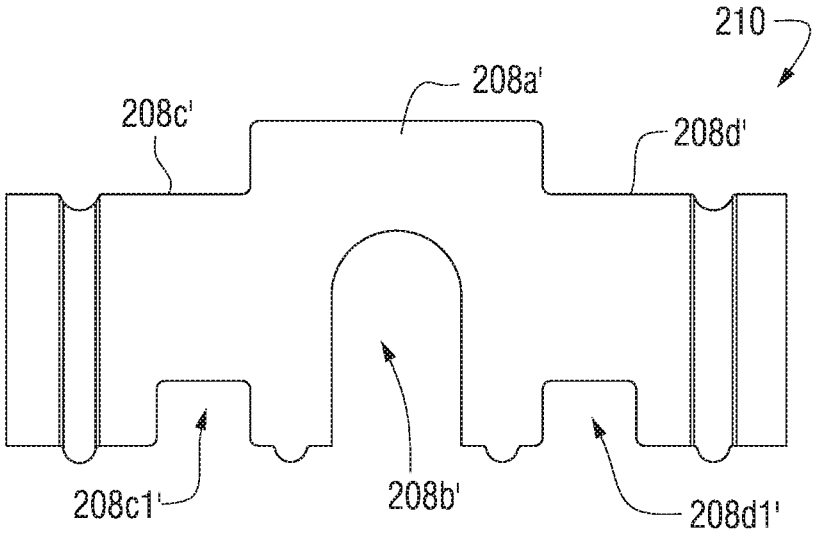
Figure 11A:
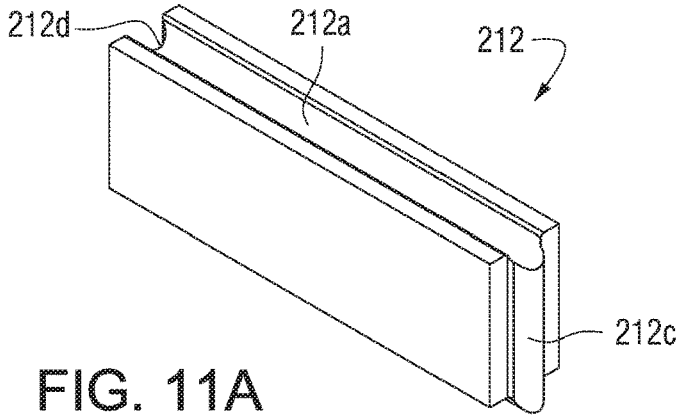
Figure 11B:
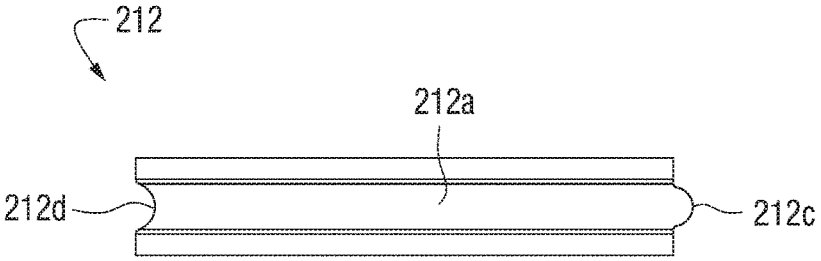
Figure 11C:
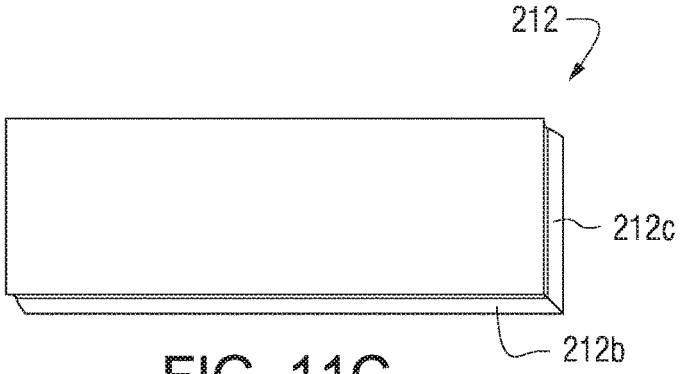
Figure 11D:
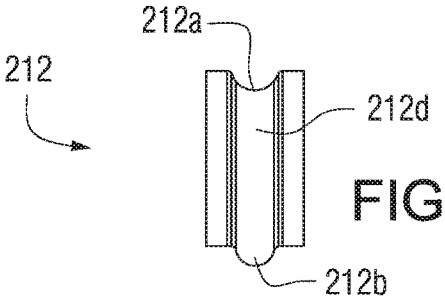
Figure 12A:
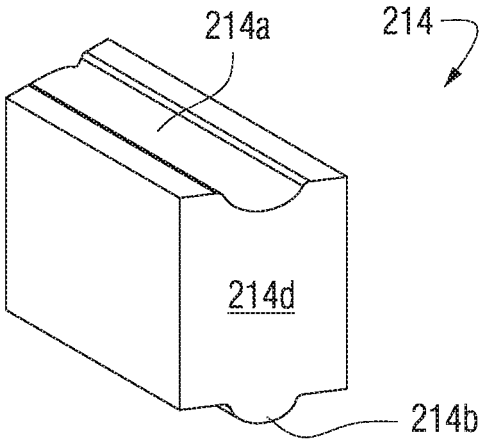
Figure 12B:
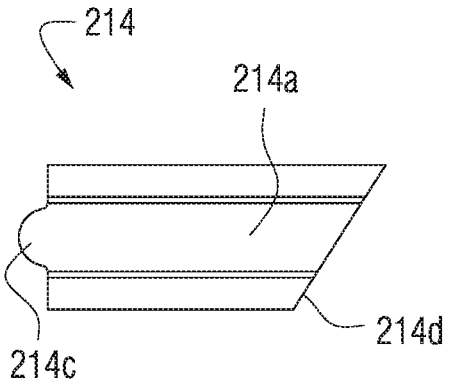
Figure 12C:
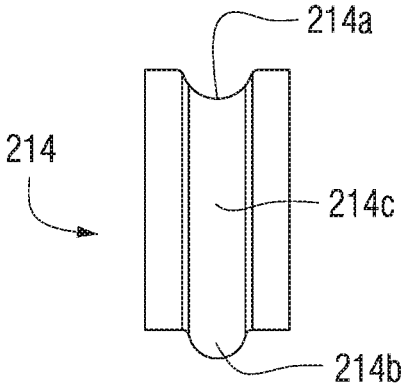
Figure 12D:
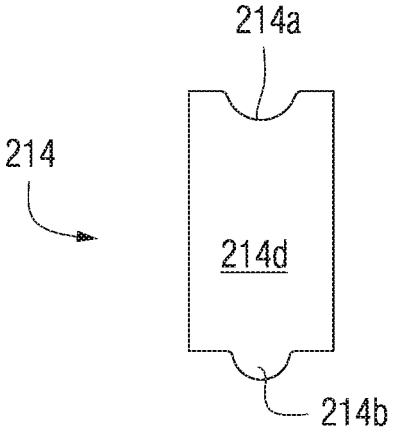

FIGS. 5A and 5B show perspective assembled views from above and below, respectively, of the interconnected refractory blocks forming the second tier 200 of the blocks associated with the corbel structure 10, with FIGS. 6A through 12D showing respective views of the individual refractory blocks thereof. In this regard, the second tier 200 of blocks is provided by an end assembly which includes a central block 202 and lateral blocks 204, 206 and a series of central flue blocks 208 which in the embodiment shown are alternately disposed adjacent to central spacer blocks 210. Elongate interior key blocks 212, 214 are provided (see FIG. 5B) so as to positionally lock and support the central end block 202.

The central end block 202 is shown in greater detail by FIGS. 6A through 6E. As shown the central end block 202 is generally a rectangular parallelepiped with a ledge projection 202*a* extending outwardly from an end thereof. The bottom surface of the central end block includes a pair of elongate tongues 202*b* which mate with corresponding grooves on a subjacent block (e.g., one of the interior key blocks 212, 214). A semi-cylindrical recess 202*c* is formed in the bottom surface of the block 202 and is open toward the rear end thereof.

A first lateral end block 204 associated with the second tier 200 of blocks forming the corbel structure 10 is shown in FIGS. 7A through 7D. As shown, the block 204 is generally in the form two conjoined rectangular parallelepiped sections 204*a*, 204*b* with the section 204*a* being laterally off-set relative to section 204*b* so as to protrude laterally therefrom. The top and bottom surfaces are provided with an elongate groove 204*c* and tongue 204*d* to mate with a corresponding tongue and groove of a superjacent and subjacent block, respectively.

The second lateral end block 206 which is positioned on a side of the central block 202 opposite to the lateral end block 204 is depicted in FIGS. 8A through 8D. As shown, the block 206 is provided with essentially a central square parallelepiped section 206*a* and a pair of parallelepiped sections 206*b*, 206*c* protruding outwardly therefrom at a forward and rearward end thereof. The section 206*c* is joined to the section 206*a* at an end thereof by a vertically oriented slanted surface 206*d*. The top surface of the section 206*a* is provided with a groove 206*e* while the forward end and bottom surface thereof are provided with coextensive tongues 206*f*, 206*g*, respectively.

FIGS. 9A through 9D show a central flue block 208 associated with the second tier 200 of blocks forming the corbel structure 10. As depicted in such drawings, the central flue block 208 is generally a rectangular parallelepiped shape provided with an upper raised platform section 208*a* defining a section of the substantially vertical flue 60. A cylindrical recess 208*a*1 is formed on the upper surface of the raised platform section so as to accommodate appropriately sized ceramic gas nozzles 220 (see FIG. 5). An elongate inverted U-shaped channel 208*b* is formed on the bottom side of the block 208. Each of the lateral side sections 208*c*, 208*d* of the block 208 includes a respective lateral inverted U-shaped channel 208*c*1, 208*d*1, respectively, between which the channel 208*b* is positioned. Elongate grooves 208*e*1, 208*f*1 and 208*e*2, 208*f*2 on the top and bottom surfaces are paired with coextensive tongues 208*g*, 208*h* and grooves 208*i*, 208*j* on opposed front and rear surfaces of the sections 208*c*, 208*d*, respectively.

The central spacer block 210 depicted in FIGS. 10A through 10D is substantially identical to the central flue block 208 but does not include the cylindrical section of flue 60 or the recess 208*a*1. As such, the block 210 has a lesser thickness dimension (i.e., the dimension of the block 210 as measured in the longitudinal direction of the corbel structure 10). Corresponding structure in block 210 has therefore been identified by the same reference numeral with a prime (') designator.

A first type of key block 212 associated with the second tier 200 of the corbel structure 10 is depicted in FIGS. 11A through 11D. As shown, the key block 212 is a generally elongate parallelepiped having a groove and tongue 212*a*, 212*b* on its top and bottom surfaces that are each coextensive with a tongue and groove 212*c*, 212*d* on its front and rear surfaces, respectively. The key block 212 may be provided in varying lengthwise dimensions so as to accommodate the particular design attributes of the corbel structure 10.

The second type of key block 214 shown in FIGS. 12A through 12D is similar to block 212 in that a top and bottom grove and tongue 214*a*, 214*b* are provided on the top and bottom surfaces which are coextensive with a tongue 214*c* formed on a rear face thereof. Unlike block 212, however, the block 214 includes a planar beveled front face 214*d*.

Figure 13:
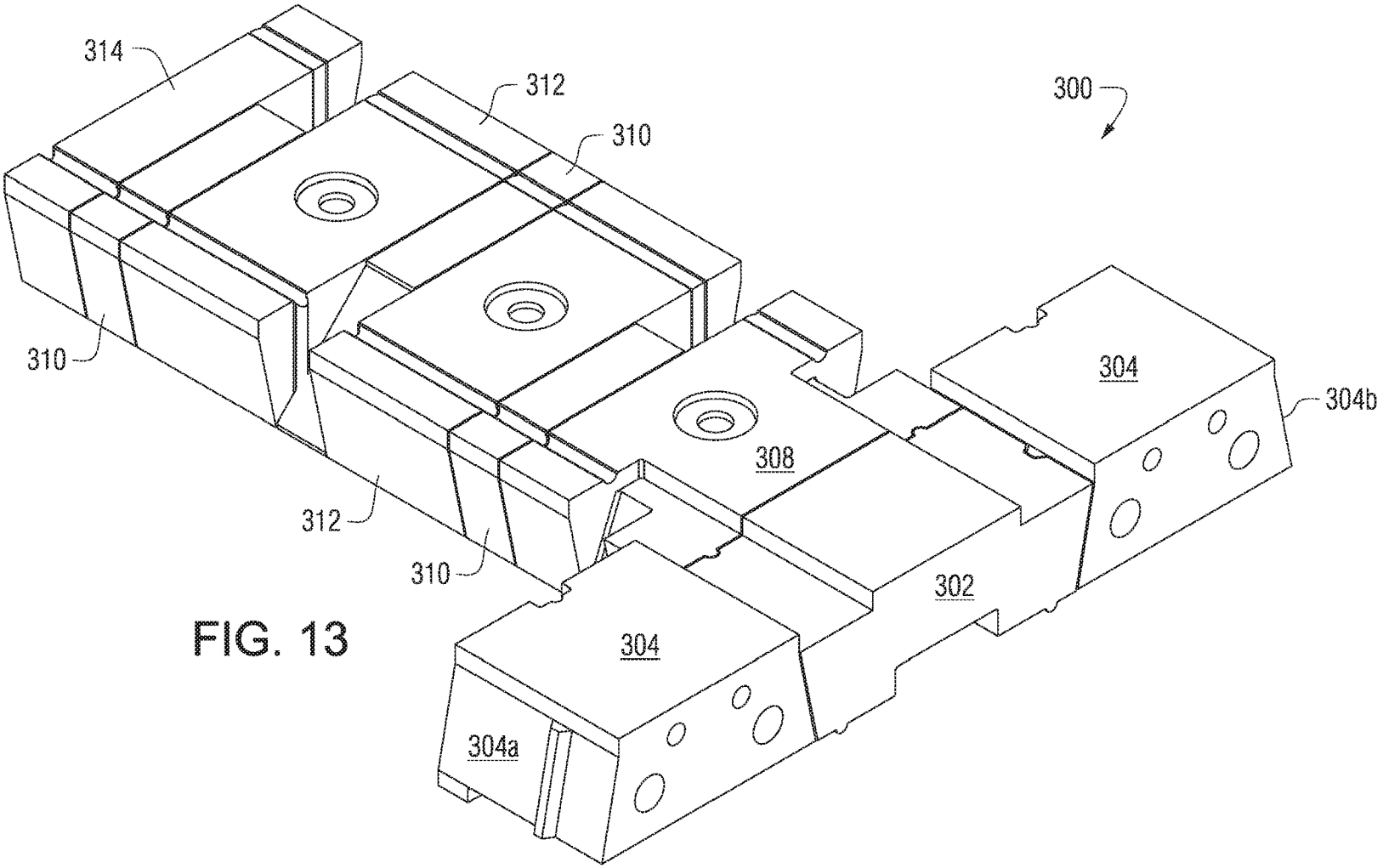
FIG. 13 is an enlarged perspective assembled view of the third tier of blocks forming the corbel structure.
Figure 14A:
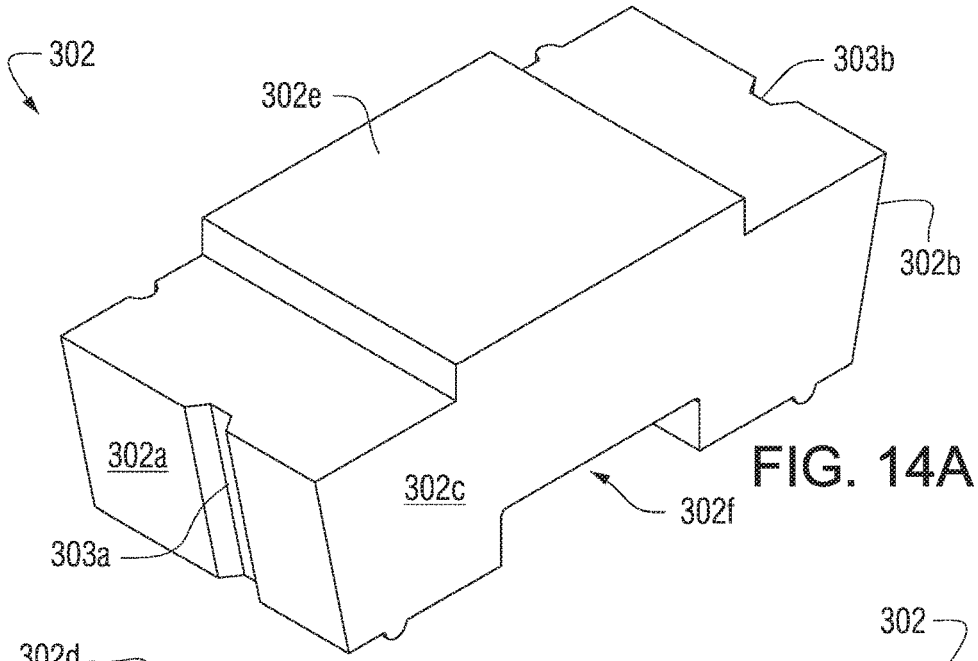
Figure 14B:
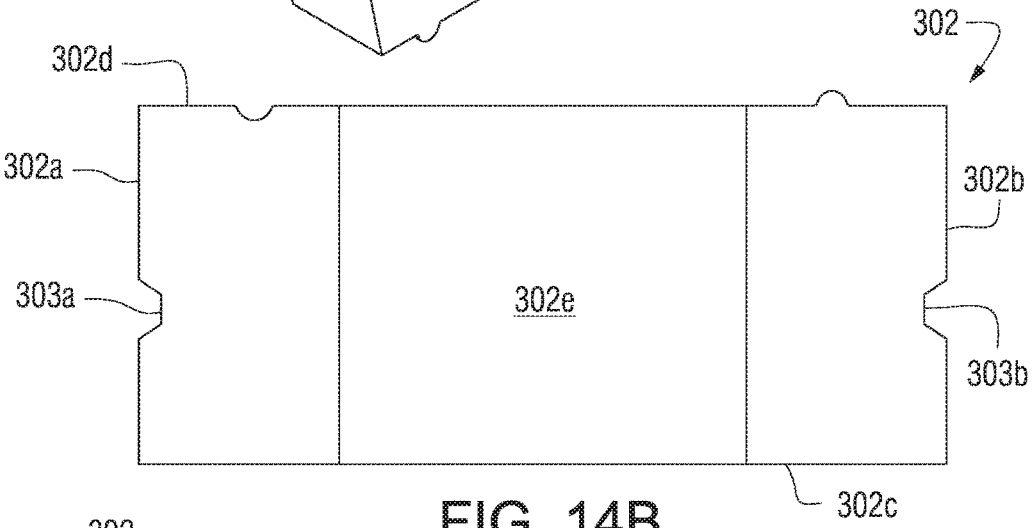
Figure 14C:
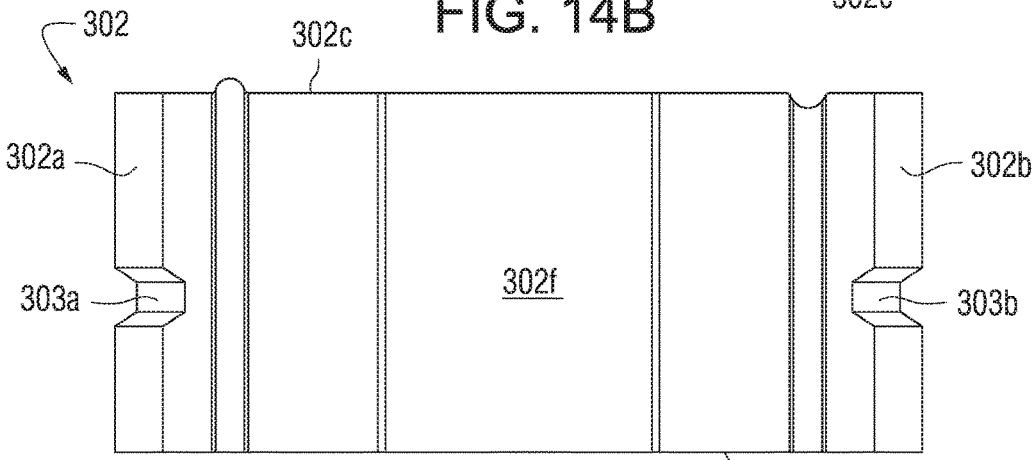
Figure 14D:
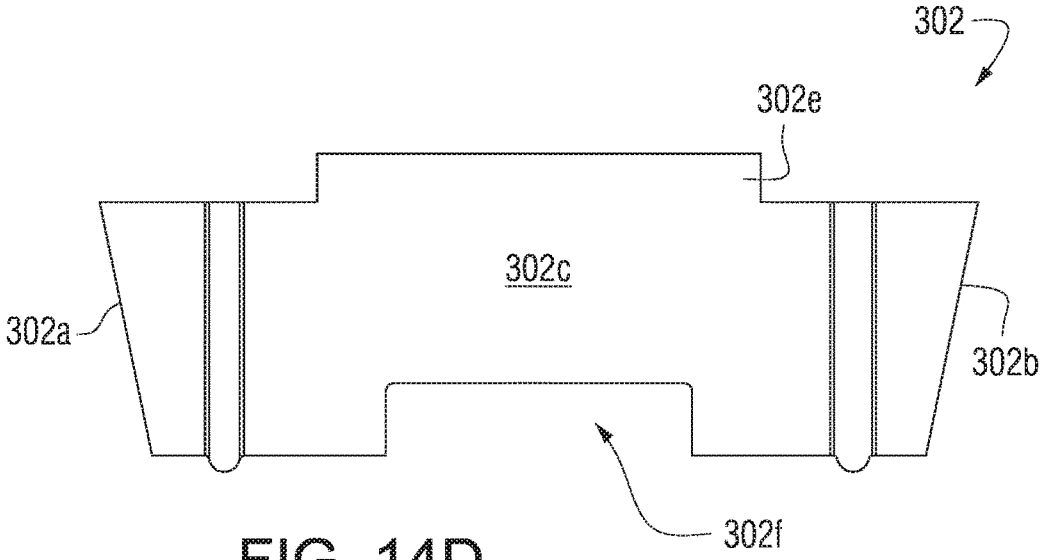
Figure 14E:
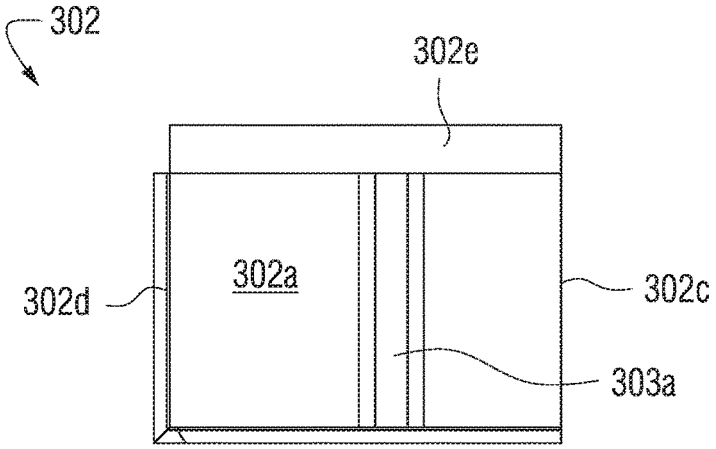
Figure 15A:
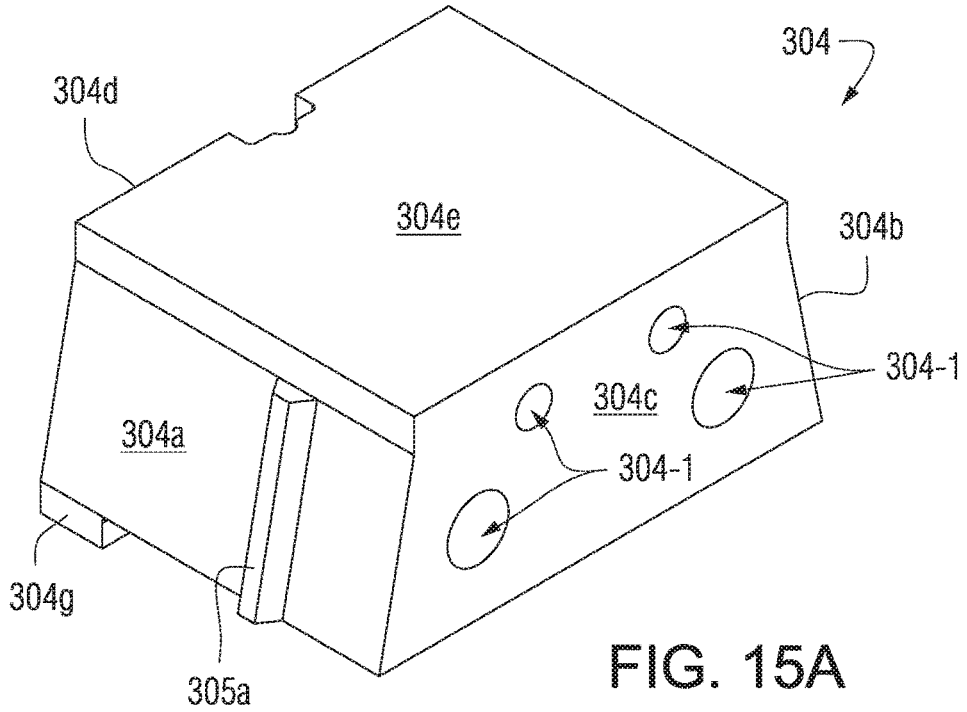
Figure 15B:
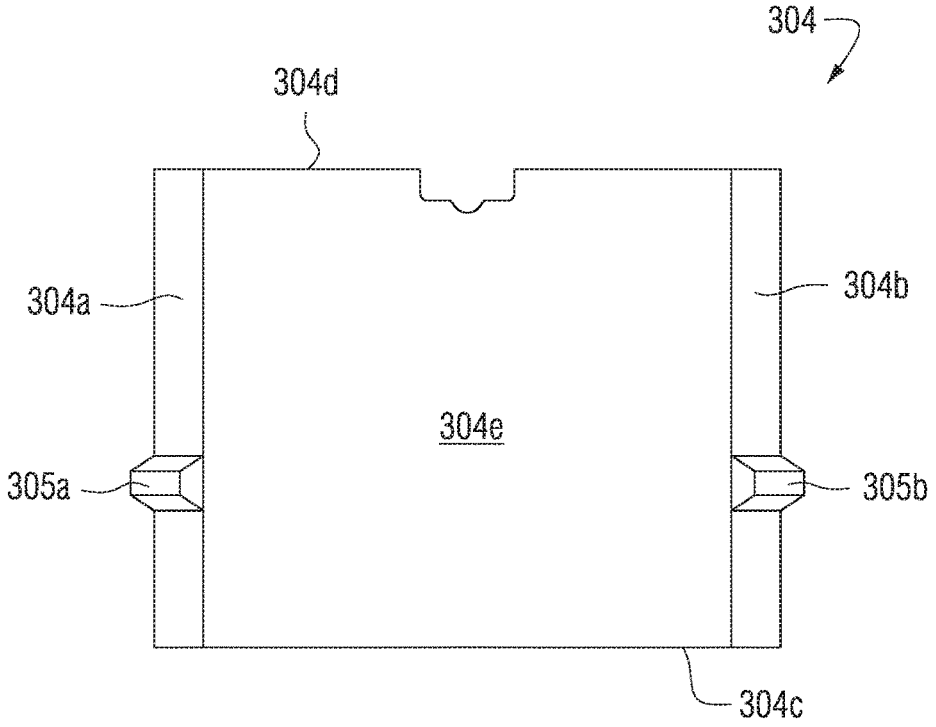
Figure 15C:
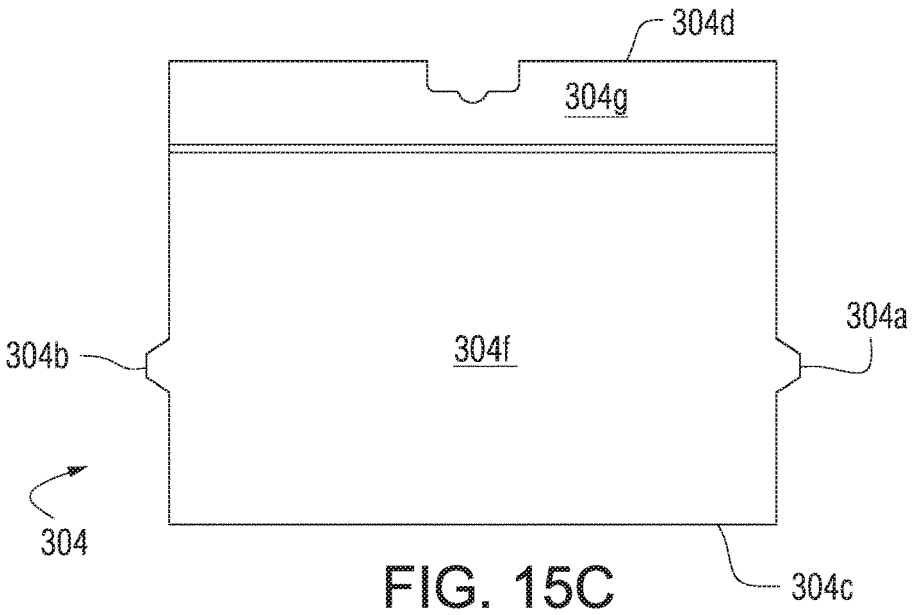
Figure 15D:
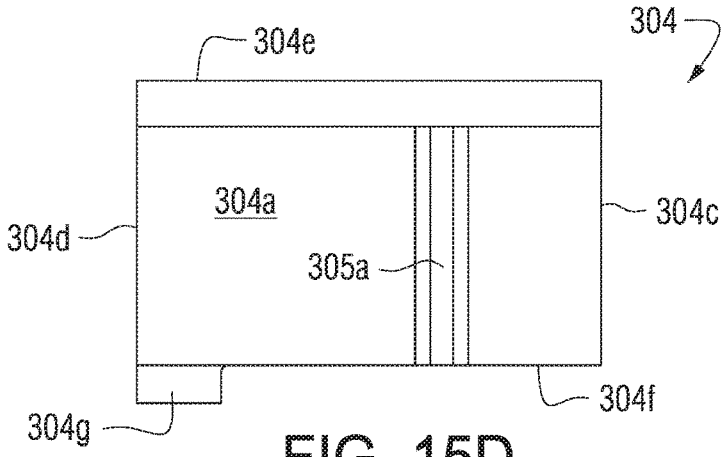
Figure 15E:
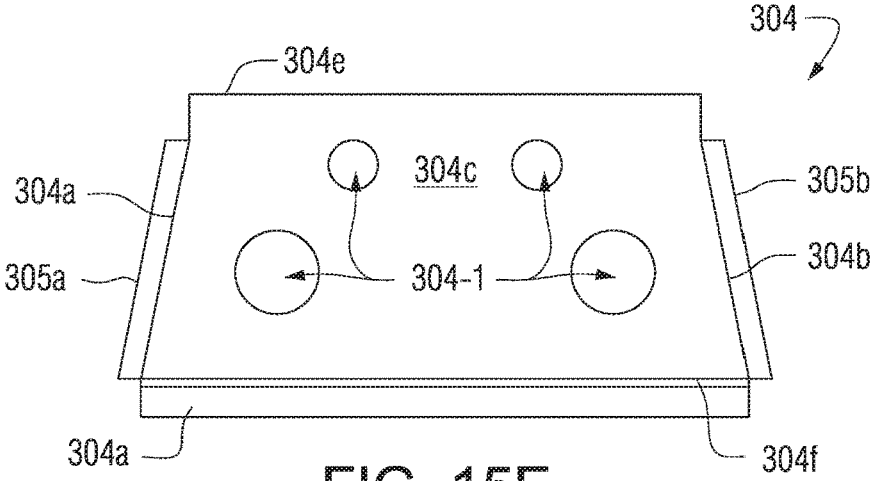

FIG. 13 shows a perspective assembled view from above of the interconnected refractory blocks forming the third tier 300 of the blocks associated with the corbel structure 10, with FIGS. 14A through 19C showing respective views of the individual refractory blocks thereof. In this regard, the third tier 300 of blocks is provided by an end assembly which includes a central end block 302 and a pair of lateral end blocks 304. The third tier 300 is also comprised of a series of first and second central flue blocks 308, 312 and diagonal flue bocks 310 interposed therebetween in oppositely alternating orientations. A spacer block 314 may also be provided as needed in the corbel structure 10 design.

FIGS. 14A through 14E show the central end block 302 associated with the third tier 300 of blocks forming the corbel structure 10. The central end block 302 is a trapezoidal solid structure having opposed downwardly converging planar side surfaces 302*a*, 302*b* and opposed substantially vertical front and rear surfaces 302*c*, 302*d*, respectively. A raised central platform 302*e* is formed on the top surface thereof while an inverted U-shaped channel 302*f* is formed in the bottom surface thereof opposite the platform 302*e*. A trapezoidal channel 303*a*, 303*b* is formed in each of the side surfaces 302*a*, 302*b*.

As shown in FIGS. 15A through 15E, the lateral end blocks 304, like the central end block 302, is a trapezoidal structure. However, the lateral end blocks 304 include opposed planar downwardly divergent side surfaces 304*a*, 304*b* having elongate trapezoidal bosses 305*a*, 305*b* which are received within the correspondingly configured channels 303*a*, 303*b* of the central end block 302. A series of cylindrical apertures 304-1 are formed in the block 304 between the substantially vertical front and rear faces 304*c*, 304*d*, respectively. The top and bottom surfaces 304*e*, 304*f*, respectively, are planar and substantially parallel to one another. A latitudinal heel 304*g* extends outwardly from the bottom surface 304*f* between the side surfaces 304*a*, 304*b*.

A first type of central flue block 308 providing both vertical and diagonally lateral flue sections 60, 72, respectively, associated with the third tier 300 of blocks forming the corbel structure 10 is depicted in accompanying FIGS. 16A through 16D. As shown, the block 308 is a generally trapezoidal solid structure having opposed downwardly convergent planar side surfaces 308*a*, 308*b*, opposed vertically planar front and rear surfaces 308*c*, 308*d* and opposed horizontally planar top and bottom surfaces 308*e*, 308*f*, respectively. Each of the side surfaces 308*a*, 308*b* includes a lateral diagonal U-shaped channel 308*a*1, 308*b*1. The bottom surface 308*f* defines a central inverted U-shaped channel 308*f*1. The upper surface 308*e* defines a central cylindrical recess 309*a* which communicates with a conical recess 309*b* defining the vertical flue section 60 (see FIG. 16D).

A diagonal flue block 310 associated with the third tier 300 of blocks forming the corbel structure 10 is depicted in FIGS. 17A through 17C. As shown, the block 310 includes an upwardly and inwardly inclined surface 310*a* at one end and a downwardly and inwardly inclined surface 310*b* at the other end. The block 310 otherwise has substantially parallel vertically planar front and rear surfaces 310*c*, 310*d* and substantially parallel horizontally planar top and bottom surfaces 310*e*, 310*f*, respectively. The upwardly and inwardly inclined surface 310*a* forms an acute interior angle with respect to the bottom surface 310*f*, whereas the downwardly and inwardly inclined surface 310*b* forms an obtuse interior angle with respect to the bottom surface 310*f*. A recess 310*f*1 is formed in the bottom surface 310*f*.

The second type of central flue block 312 depicted in FIGS. 18A through 18E is substantially identical to the first type of central flue block 308 but does not include the lateral diagonal U-shaped channel 308*a*1, 308*b*1. As such, the block 312 has a lesser thickness dimension (i.e., the dimension of the block 312 as measured in the longitudinal direction of the corbel structure 10). Corresponding structure in block 312 to that shown in block 308 has therefore been identified by the same reference numeral with a prime (') designator.

Likewise, the spacer block 314 depicted in FIGS. 19A through 19C is substantially identical to the second type of central flue block 312 but does not include the cylindrical recess 309*a*' or the conical recess 309*b*'. As such, the block 314 has a lesser thickness dimension (i.e., the dimension of the block 314 as measured in the longitudinal direction of the corbel structure 10). Corresponding structure in block 314 to that shown in block 312 has therefore been identified by the same reference numeral with a double prime (") designator.

FIG. 20 shows show perspective assembled view from above of the interconnected refractory blocks forming the fourth tier 400 of the blocks associated with the corbel structure 10, with FIGS. 21A through 29C showing respective views of the individual refractory blocks thereof. In this regard, the fourth tier 400 of blocks is provided by a adjacently positioned series central end block 402, first and second types of saddle flue blocks 404, 406, respectively, central diagonal flue blocks 408, spacer blocks 410, elongate upper edge blocks 412, first and second types of central shelf blocks (a representative few of which are identified by reference numerals 414, 416, respectively), and lateral shelf blocks (a representative few of which re identified by reference numeral 418).

The end block 402 associated with the fourth tier 400 of blocks forming the corbel structure 10 is depicted in greater detail in FIGS. 21A through 21C. As shown, the end block 402 is generally a trapezoidal structure having upper and lower step surfaces 402*a*, 402*b* on each lateral side thereof. A generally rectangular boss 402*c*1 projects outwardly from the substantially horizontal front face 402*c* opposed to a substantially planar rear face 402*d*. The top and bottom faces 402*e* and 402*f*, respectively, are substantially planar rectangular surfaces.

FIGS. 22A through 22D depict the first type of saddle block 404 associated with the fourth tier 400 of blocks forming the corbel structure 10. As shown, the block 404, is generally a trapezoidal structure having upper and lower step surfaces 404*a*, 404*b* on each lateral side thereof, opposed front and rear substantially vertical planar surfaces 404*c*, 404*d* and opposed top and bottom substantially horizontal planar surfaces 404*e*, 404*f*, respectively. An open ended rectangular recess 405 is formed in the top and rear faces 404*e* and 404*d*, respectively, so as to receive a correspondingly configured flue block 407 (see FIG. 20). The bottom of each flue block 407 includes a cylindrical boss (not shown) which is received within a correspondingly configured cylindrical recess 405*a* communicating with a substantially vertically oriented cylindrical flue 405*b* of the block 404 (see FIG. 22D). As noted in the drawings, the flue blocks 407 may be of different vertical heights. The bottom surface 404*f* includes a cylindrical boss 405*c* which is received within the correspondingly configured cylindrical recess 309*a* of the block 308 when stacked thereon (see FIGS. 16A through 16D). An opposed pair of arcuately concave flue channels 404-1, 404-2 are defined within the block 404 between the top and bottom surfaces 404*e*, 404*f*, respectively, so that the upper opening to each flue channel 404-1, 404-2 is inwardly offset relative to the lower opening thereof.

The second type of saddle block 406 associated with the fourth tier 400 of blocks forming the corbel structure 10 is depicted in FIGS. 23A through 23D. As shown, the block 406, like blocks 402 and 404, includes upper and lower step surfaces 406*a*, 406*b* on each lateral side thereof. The block 406 also includes a laterally opposed pair of upright columns 406-1, 406-2 which define therebetween a rectangular channel 409 for receiving a correspondingly configured flue block 407. As noted previously, the bottom of each flue block 407 includes a cylindrical boss (not shown) which is received within a correspondingly configured cylindrical recess 409*a* communicating with a substantially vertically oriented cylindrical flue 409*b* of the block 406 (see FIG. 23D). The bottom surface 406*f* includes a cylindrical boss

409*c* which is received within the correspondingly configured cylindrical recess 309*a*' of the flue block 312 of the third tier 300 of blocks when stacked thereon (see FIGS. 18A through 18E).

FIGS. 24A through 24D depict a central diagonal flue block 408 associated with the fourth tier 400 of blocks forming the corbel structure 10. As shown, the flue block 408, like the blocks 402, 404 and 406, is generally a trapezoidal structure having upper and lower step surfaces 408*a*, 408*b* on each lateral side thereof, opposed front and rear substantially vertical planar surfaces 408*c*, 408*d* and opposed top and bottom substantially horizontal planar surfaces 408*e*, 408*f*, respectively. An arcuately concave flue channel 408-1 is defined within the block 408 between the top and bottom surfaces 408*e*, 408*f*, respectively, so that the upper opening to the flue channel 408-1 is inwardly offset relative to the lower opening thereof.

A central spacer block 410 that may be employed in the fourth tier 400 of blocks forming the corbel structure 10 is depicted in FIGS. 25A through 25C. As shown, the spacer block 410, like the blocks 402, 404, 406 and 408, is generally a trapezoidal structure having upper and lower step surfaces 410*a*, 410*b* on each lateral side thereof, opposed front and rear substantially vertical planar surfaces 410*c*, 410*d* and opposed top and bottom substantially horizontal planar surfaces 410*e*, 410*f*, respectively.

An elongate upper edge block 412 associated with the fourth tier 400 of blocks forming the corbel structure 10 is shown in FIGS. 26A through 26D. As shown the edge block 412 is structurally similar to the key block 212 described previously in connection with the second tier 200 of blocks. As shown, the edge block 412 is a generally elongate parallelepiped having a groove and tongue 412*a*, 412*b* on its top and bottom surfaces that are each coextensive with a tongue and groove 412*c*, 412*d* on its front and rear surfaces, respectively. The edge block 412 may be provided in varying lengthwise dimensions so as to accommodate the particular design attributes of the corbel structure 10.

FIGS. 27A and 27B depict a first type of central shelf block 414 employed in the fourth tier 400 of the corbel structure 10. As shown, the block 414 is substantially a T-shaped structure having a central column section 414*a* and opposed outwardly projecting ledge sections 414*b*, 414*c*.

FIGS. 28A and 28B depict a second type of central shelf block 416 employed in the fourth tier 400 of the corbel structure 10. As shown, the block 416, like the block 414, is substantially a T-shaped structure having a central column section 416*a* and opposed outwardly projecting ledge sections 416*b*, 416*c*. In addition, the block 416 also includes a pair of downwardly projecting feet 416-1, 416-2 which define therebetween an inverted U-shaped channel 416-3.

FIGS. 29A through 29C depict a lateral shelf block 418 associated with the fourth tier 400 of blocks forming the corbel structure 10. As shown, the block 418 is substantially a Z-shaped structure having a central post section 418*a* and oppositely oriented ledge sections 418*b*, 418*c* at each end thereof. As is shown in FIG. 20, an oppositely oriented pair of the Z-shaped shelf blocks 418 is associated with one of the T-shaped shelf blocks 414 or 416 so that the outwardly projecting ledge sections 414*b*, 414*c* or 416*b*, 416*c* are received and supported by a ledge section 418*c* of a respective block 418. In addition, it will be observed from FIG. 20 that the ledge sections 418*b* of the interior series of blocks 418 are received and supported by a respective lower step surface 402*b*, 404*b*, 406*b*, 408*b* and 410*b* of a respectively associated adjacent block 402, 404, 406, 408 and 410. The collective top surfaces of blocks 412, 414 and 418 therefore provide a coplanar support surface for supporting a row of generally rectangular edge blocks 420 (see FIG. 20).

The various blocks as described above which comprise the corbel structure 10 are preferably provided with interlocking tongue and groove structures such as described in U.S. Provisional Patent Application Ser. No. 62/082,922.

It will be understood that the description provided herein is presently considered to be the most practical and preferred embodiments of the invention. Thus, the invention is not to be limited to the disclosed embodiments, but on the contrary, is intended to cover various modifications and equivalent arrangements included within the spirit and scope thereof.

What is claimed is:

1. A corbel structure for a coke over comprising:

an assembly of multiple stacked tiers of refractory blocks defining a plurality of substantially vertically oriented central flues and a plurality of generally diagonally oriented lateral flues, wherein at least one tier of refractory blocks in the assembly includes an alternating plurality of saddle blocks and central diagonal flue blocks, wherein the saddle blocks comprise a laterally opposed pair of upright columns which define therebetween a rectangular channel, and a substantially vertically oriented cylindrical flue extending from a bottom surface of the saddle blocks to the rectangular channel thereof, and wherein the substantially vertically oriented cylindrical flue defines a substantially vertically oriented central flue; and wherein the central diagonal flue blocks comprise an arcuately concave flue channel defined between top and bottom surfaces thereof so that an upper opening to the flue channel at the top surface is inwardly offset relative to a lower opening thereof at the bottom surface, and wherein the arcuately concave flue channel defines a generally diagonally oriented lateral flue.

2. The corbel structure according to claim 1, wherein the saddle blocks and the central diagonal flue blocks are generally trapezoidal having step surfaces on opposed lateral edges thereof.

3. The corbel structure according to claim 1, wherein the saddle blocks comprise a cylindrical boss which is received within a correspondingly configured cylindrical recess of another block in a subjacent tier of the corbel structure.

4. The corbel structure according to claim 2, wherein the at least one tier of refractory blocks further comprises a series of substantially Z-shaped blocks having a central post section and oppositely oriented ledge sections at each end of the central post section, wherein one of the ledge sections of the Z-shaped blocks is received and supported by a respective one of the step surfaces of the saddle blocks and the central diagonal flue blocks.

5. The corbel structure according to claim 4, wherein the at least one tier of refractory blocks further comprises a series of substantially T-shaped blocks laterally adjacent to the series of Z-shaped blocks.

6. The corbel structure according to claim 5, wherein the T-shaped blocks include a central column and opposed outwardly projecting ledge sections at an upper end of the central column, wherein one of the outwardly projecting ledge sections of the T-shaped blocks is received and supported by a respective oppositely oriented ledge section of the Z-shaped blocks.

7. The corbel structure according to claim 6, wherein the at least one tier of refractory blocks further comprises at least one generally trapezoidal spacer block positioned adjacent one of the saddle blocks and central diagonal flue blocks.

8. The corbel structure according to claim 1, wherein at least one of the saddle blocks further comprises a pair of oppositely oriented arcuate lateral flues on respective lateral sides of the substantially vertically oriented cylindrical flue.

9. The corbel structure according to claim 8, wherein the rectangular channel comprises a cylindrical recess at an upper end of the substantially oriented vertical flue.

10. The corbel structure according to claim 9, wherein the bottom surface of the saddle blocks includes a cylindrical boss at a lower end of the substantially vertical cylindrical flue.

11. The corbel structure according to claim 1, wherein the at least one tier of refractory blocks further comprises substantially rectangular flue blocks received within a respective one of the rectangular channels of the saddle blocks.

12. The corbel structure according to claim 11, wherein the central diagonal flue blocks are alternately oppositely oriented in the at least one tier of refractory blocks so that the lower openings thereof are positioned on alternately opposite laterals sides of the corbel structure.

13. The corbel structure according to claim 1, wherein the assembly of multiple stacked tiers of refractory blocks further comprises a second tier of refractory blocks subjacent to the at least one tier of refractory blocks, wherein the second tier of refractor blocks comprises an alternating series of central flue blocks and diagonal flue blocks, wherein the central flue blocks define a substantially vertical flue section in fluid communication with the substantially vertically oriented cylindrical flue of the saddle blocks, and wherein the diagonal flue blocks define a downwardly and outwardly inclined surface at one end thereof in fluid communication with the lower opening of the arcuately concave flue channel defined by a respective one of the central diagonal flue blocks in the at least one tier of refractory blocks.

14. The corbel structure according to claim 13, wherein the central diagonal flue blocks of the at least one tier of refractory blocks are alternately oppositely oriented so that the lower openings of the arcuately concave flue channels are positioned on alternately opposite laterals sides of the corbel structure, and wherein the diagonal flue blocks of the second tier of refractory blocks are alternately oppositely oriented so that the inclined surface at one end thereof is in fluid communication with a respective one of the arcuately concave flue channels of the central diagonal flue blocks of the at least one tier of refractory blocks.

15. The corbel structure according to claim 14, further comprising at least one additional tier comprised of a plurality of tongue-and-groove interconnected refractory blocks, wherein the plurality of interconnected refractory blocks of the at least one additional tier comprise mutually substantially orthogonal faces defining an edge and respectively including an elongate tongue protruding outwardly therefrom and an elongate groove recessed therein, and wherein the elongate tongue and groove include respective adjacent ends which co-terminate with one another at the edge defined by the mutually orthogonal faces of the refractory blocks.

16. The corbel structure according to claim 15, wherein the multiple stacked tiers of refractory blocks include a respective end block having a front face, wherein the front face includes a substantially vertically oriented tongue and a substantially vertically oriented groove parallel with the tongue, the tongue and groove of the front face being interconnected with a groove and tongue, respectively, of a substantially vertical face of an adjacent block in the tier.

* * * * *